US009747850B2

(12) United States Patent
Fujikawa

(10) Patent No.: US 9,747,850 B2
(45) Date of Patent: Aug. 29, 2017

(54) LEVEL SHIFT CIRCUIT, ELECTRO-OPTICAL APPARATUS, AND ELECTRONIC EQUIPMENT

(71) Applicant: SEIKO EPSON CORPORATION, Tokyo (JP)

(72) Inventor: Shinsuke Fujikawa, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 48 days.

(21) Appl. No.: 14/775,681

(22) PCT Filed: Mar. 11, 2014

(86) PCT No.: PCT/JP2014/001356
§ 371 (c)(1),
(2) Date: Sep. 12, 2015

(87) PCT Pub. No.: WO2014/141687
PCT Pub. Date: Sep. 18, 2014

(65) Prior Publication Data

US 2016/0035295 A1 Feb. 4, 2016

(30) Foreign Application Priority Data

Mar. 14, 2013 (JP) ..... 2013-051368

(51) Int. Cl.
*G09G 3/36* (2006.01)

(52) U.S. Cl.
CPC ..... *G09G 3/3611* (2013.01); *G09G 3/3648* (2013.01); *G09G 3/3696* (2013.01);
(Continued)

(58) Field of Classification Search
CPC ..... G09G 3/3648; G09G 3/3696; G09G 3/36; G09G 3/3611; G09G 2310/0286; G09G 2310/0289
(Continued)

(56) References Cited

U.S. PATENT DOCUMENTS 6,714,046 B2 * 3/2004 Fujikawa ..... H03K 19/018571 326/62
7,136,311 B2 * 11/2006 Fujikawa ..... G09G 3/3688 365/189.02
(Continued)

FOREIGN PATENT DOCUMENTS

JP 2003-110419 A 4/2003
JP 2004-235995 A 8/2004
(Continued)

*Primary Examiner* — Vijay Shankar
(74) *Attorney, Agent, or Firm* — Maschoff Brennan

(57) ABSTRACT

To realize a level shift circuit with the small occupation area and capable of performing high-speed operation, a level shift circuit includes an electric potential converting unit that converts a first electric potential of an input signal to a third electric potential and converts a second electric potential of an input signal to a fourth electric potential. A capacitor includes first and second electrodes, the first electrode being electrically connected to the input unit, and the second electrode being electrically connected to an output node of the electric potential converting unit. A buffer unit converts the third and fourth electrical potentials to fifth and sixth electrical potentials, respectively. The capacitor reflects the input signal in the electric potential of the output node of the electric potential converting unit without delay by capacitive coupling, thereby realizing a level shift circuit that is capable of performing high-speed operation.

9 Claims, 15 Drawing Sheets

(52) U.S. Cl.
CPC ..... *G09G 2310/0286* (2013.01); *G09G 2310/0289* (2013.01)

(58) Field of Classification Search
USPC ..... 345/87–100
See application file for complete search history.

(56) References Cited

U.S. PATENT DOCUMENTS

| | | | | |
|---|---|---|---|---|
| 7,545,174 | B2 * | 6/2009 | Senda | H03K 19/018521 326/68 |
| 8,395,870 | B2 * | 3/2013 | Maede | H03K 19/0185 326/82 |
| 2003/0001616 | A1 | 1/2003 | Fujikawa et al. | |
| 2007/0279093 | A1 | 12/2007 | Senda et al. | |
| 2012/0049939 | A1 | 3/2012 | Maede | |

FOREIGN PATENT DOCUMENTS

| | | | |
|---|---|---|---|
| JP | 2005-191630 | A | 7/2005 |
| JP | 2006-033794 | A | 2/2006 |
| JP | 2006-270132 | A | 10/2006 |
| JP | 2008-022539 | A | 1/2008 |
| WO | 2010/140276 | A1 | 12/2010 |

* cited by examiner

LEVEL SHIFT CIRCUIT, ELECTRO-OPTICAL APPARATUS, AND ELECTRONIC EQUIPMENT

TECHNICAL FIELD

The present invention relates to a level shift circuit, an electro-optical apparatus, and an electronic equipment.

BACKGROUND ART

For an electronic equipment with a display function, a transmission-type electro-optical apparatus or a reflecting-type electro-optical apparatus is being used. These electro-optical apparatuses are irradiated with light so that transmitted light or reflected light modulated by an electro-optical apparatus becomes a display image or becomes a projection image by being projected to a screen. For an electro-optical apparatus used in this type of electronic equipment, a liquid crystal device is known, which forms an image by using dielectric anisotropy of liquid crystal and optical rotatory of the light at a liquid crystal layer.

In general, to drive an electro-optical apparatus, relatively high voltage is required. Meanwhile, an outside control circuit that provides a clock signal or a control signal or the like, which is a standard of driving, is configured in a semiconductor integrated circuit of the electro-optical apparatus, and the amplitude of these logic signals is low, ranging from about 1.8 V to about 5 V. Therefore, in an electro-optical apparatus, it is general that an amplitude conversion circuit that converts a logic signal with low voltage from a semiconductor integrated circuit to a logic signal with high voltage (hereinafter referred to as level shift circuit) is provided. An example of a level shift circuit is stated in PTL 1. In FIG. 1 of PTL 1, a level shift circuit operated by capacitive coupling is stated.

CITATION LIST

Patent Literature

PTL 1: Japanese Unexamined Patent Application Publication No. 2003-110419

SUMMARY OF INVENTION

Technical Problem

However, in the level shift circuit stated in Patent Document 1, there is a problem that the occupation area of the circuit becomes large in order to include an electric potential control circuit operated by a signal feedback. In addition, in a liquid crystal device, for a data capacity accompanied to a display image being a high-definition image to be increased, and further, for improvement of video display properties and for high-speed driving required from the surface of three-dimensional display driving, high-speed operation of a level shift circuit is strongly required. In other words, in a level shift circuit of the related art, there is a problem that it is difficult to perform high-speed operation in a circuit of which the occupation area is small (or a circuit with a small size).

Solution to Problem

This invention provides a solution to at least a part of the above-described problems and is capable of realize the solution as the following embodiments or application examples.

Application Example 1

A level shift circuit according to this application example includes, an input unit to which an input signal that acquires a value between a first electric potential and a second electric potential is input; an electric potential converting unit that converts the first electric potential to a third electric potential and converts the second electric potential to a fourth electric potential; a capacitor that includes a first electrode and a second electrode, the first electrode being electrically connected to the input unit, the second electrode being electrically connected to an output node of the electric potential converting unit; and a buffer unit that converts the third electric potential to a fifth electric potential and converts the fourth electric potential a sixth electric potential, in which the output node of the electric potential converting unit and an input node of the buffer unit are electrically connected to each other.

According to this configuration, the capacitor reflects the input signal with a low amplitude capacity in the electric potential of the output node of the electric potential converting unit without delay by capacitive coupling, and thus it is possible to realize a level shift circuit that is capable of conducting high-speed operation. In addition, since the level shift circuit is small-sized, it is possible to render the occupation area to be small. In other words, it is possible to realize a level shift circuit with the small occupation area and capable of conducting high-speed operation.

Application Example 2

In the level shift circuit according to the application example, it is preferable that the capacity unit includes a transistor, the gate of the transistor constitutes either one of the first electrode and the second electrode to turn on the transistor, and the source and the drain of the transistor constitute the other of the first electrode and the second electrode.

According to this configuration, it is possible to use the gate capacity of the transistor as the capacitor, a special process addition or a special circuit layout is not required for establishing the capacitor. For this, by increasing the degree of freedom in a circuit design and by a simple production process the same as a common process, it is possible to realize a level shift circuit with the small occupation area and capable of conducting high-speed operation. In addition, since the transistor is connected so as to be turned on, a depletion layer capacity is not generated and it is possible to configure a capacitor in a transistor with a narrow area.

Application Example 3

In the level shift circuit according to the application example, it is preferable that the buffer unit includes a logic threshold electric potential, the third electric potential is a value between the logic threshold electric potential and the fifth electric potential, and the fourth electric potential is a value between the logic threshold electric potential and the sixth electric potential.

According to this configuration, it is possible to correctly convert the amplitude of the input signal that acquires a value between the first electric potential and the second electric potential to the output signal acquires a value between the fifth electric potential and the sixth electric potential.

Application Example 4

In the level shift circuit according to the application example, it is preferable that, in the buffer unit, a first inverter and a second inverter are electrically connected in series between the input node of the buffer unit and an output node of the buffer unit.

According to this configuration, it is possible to configure the buffer unit in a simple configuration of two inverters. In addition, it is possible to render the third electric potential and the fourth electric potential which are electric potentials close to a middle value between the fifth electric potential and the sixth electric potential to be approximately the fifth electric potential and the sixth electric potential in the output unit.

Application Example 5

In the level shift circuit according to the application example, it is preferable that, in the electric potential converting unit, a first conductivity-type transistor and a second conductivity-type transistor are electrically connected in series between the input unit and a wiring in which the sixth electric potential is provided, the source of the first conductivity-type transistor is electrically connected to the input unit, the source of the second conductivity-type transistor is electrically connected to the wiring in which the sixth electric potential is provided, and the drain of the first conductivity-type transistor and the drain of the second conductivity-type transistor are electrically connected to the gate of the first conductivity-type transistor and the gate of the second conductivity-type transistor.

According to this configuration, it is possible to convert the first electric potential to the third electric potential and convert the second electric potential to the fourth electric potential by a simple circuit. In addition, the third electric potential and the fourth electric potential need to insert the logic threshold electric potential of the buffer unit. In this configuration, however, the third electric potential and the fourth electric potential can be adjusted by adjusting the size of the first conductivity-type transistor and the second conductivity-type transistor, and thus it is possible to set so that the third electric potential and the fourth electric potential can easily insert the logic threshold electric potential of the buffer unit. In other words, it is possible to easily form a level shift circuit that correctly functions.

Application Example 6

An electro-optical apparatus including the level shift circuit according to any one of the above application examples.

According to this configuration, it is possible to realize an electro-optical apparatus that narrows a peripheral area at the outer boundary of a display area and performs high-speed driving. In other words, it is possible to render an electro-optical apparatus with a great ratio of a display area to the entire electro-optical apparatus and with excellent design properties to conduct high-definition display.

Application Example 7

An electronic equipment including the electro-optical apparatus according to the above application example.

According to this configuration, it is possible to realize an electronic equipment that includes an electro-optical apparatus with excellent design properties and that is capable of performing high-definition display.

DESCRIPTION OF EMBODIMENTS

Hereinafter, the embodiments herein will be described with reference to the drawings. Yet, in each following figure, the measurements of each part and each material appear different from the actual measurement since each part and each material is presented in a recognizable size.

First Embodiment

[Circuit Function]

Figure 1:
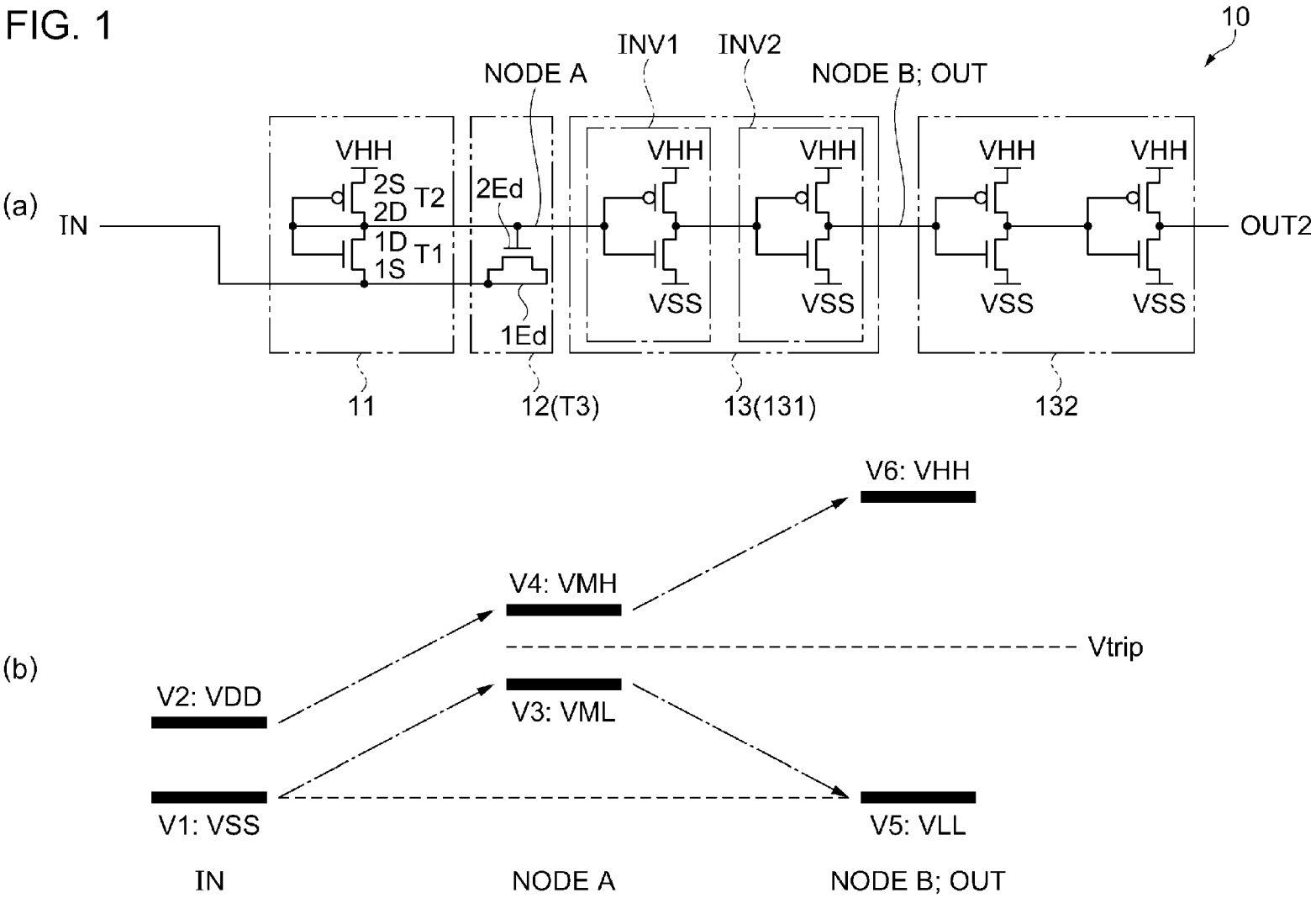
FIG. 1 is a view illustrating a level shift circuit according to a first embodiment.

FIG. 1 is a view illustrating a level shift circuit according to a first embodiment. FIG. 1(*a*) is a circuit configuration diagram and FIG. 1(*b*) is an electric potential relationship diagram. First, the function of a level shift circuit 10 according to a first embodiment will be described with reference to FIG. 1.

As described in FIG. 1(*a*), the level shift circuit 10 of this embodiment includes at least an input unit IN in which an input signal is input, an electric potential converting unit 11, a capacitor 12, a buffer unit 13, and an output unit OUT from which an output signal is output. The level shift circuit 10 is a circuit that converts a logic signal from a low-voltage circuit not illustrated in the drawings to a logic signal suitable for a high-voltage circuit not illustrated in the drawings.

An input signal towards the level shift circuit 10 is formed at the low-voltage circuit (for example, an outer control circuit configured at a semiconductor integrated circuit) and, as illustrated in FIG. 1(*b*), acquires a value between a first electric potential V1 and a second electric potential V2. The first electric potential V1 is one of two power supply electric potentials applied at the low-voltage circuit (positive power supply electric potential and negative power supply electric potential), while the second electric potential V2 is the other of two power supply electric potentials applied at the low-voltage circuit (positive power supply electric potential and negative power supply electric potential). In this embodiment, the first electric potential V1 is a negative power supply electric potential of the low-voltage circuit (referred to as a low-voltage negative power supply electric potential VSS), while the second electric potential V2 is a positive power supply electric potential of the low-voltage circuit (referred to as a low-voltage positive power supply electric potential VDD). The input signal includes at least one of logic 0 or logic 1. In this embodiment, the input signal corresponding to the logic 0 is the first electric potential V1, or an electric potential that is close to the first electric potential V1 and at least acquires the value of the first electric potential V1 rather than the average electric potential of the first electric potential V1 and the second electric potential V2. Likewise, the input signal corresponding to the logic 1 is the second electric potential V2, or an electric potential that is close to the second electric potential V2 and at least acquires the value of the second electric potential V2 rather than the average electric potential of the first electric potential V1 and the second electric potential V2. The amplitude of the logic signal in the low-voltage circuit (a logic signal with a low amplitude, a potential difference between the first electric potential V1 and the second electric potential V2) is mostly from about 1.8 V to 5 V.

The electric potential converting unit 11 converts the first electric potential V1 to a third electric potential V3, converts the second electric potential V2 to a fourth electric potential V4, and outputs the converted electric potential to the output node of the electric potential converting unit 11. In other words, the input signal that acquires a value between the first electric potential V1 and the second electric potential V2 is converted to a middle signal that acquires a value between the third electric potential V3 and the fourth electric potential V4. More specifically, the middle signal corresponding to the input signal of the logic 0 is the third electric potential V3 or an electric potential close to the third electric potential V3, while the middle signal corresponding to the input signal of the logic 1 is the fourth electric potential V4 or an electric potential close to the fourth electric potential V4. In this embodiment, the third electric potential V3 is a low electric potential among the middle signal at the output node of the electric potential converting unit 11 (referred to as a middle low electric potential VML), while the fourth electric potential V4 is a high electric potential among the middle signal at the output node of the electric potential converting unit 11 (referred to as a middle high electric potential VMH).

An output node of the electric potential converting unit 11 and an input node of the buffer unit 13 are electrically connected, and an output from the electric potential converting unit 11 is input to the buffer unit 13. Hereinafter, the output node of the electric potential converting unit 11 and the output node of the buffer unit 13 are referred to as a NODE A. The buffer unit 13 converts the third electric potential V3 input into the buffer unit 13 to the fifth electric potential V5 or an electric potential close to the fifth electric potential V5, converts the fourth electric potential V4 to the sixth electric potential V6 or an electric potential close to the sixth electric potential V6, and outputs the output signal that acquires a value between the fifth electric potential V5 and the sixth electric potential V6 from the output node of the buffer unit 13. The output node of the buffer unit 13 is an output unit OUT of the level shift circuit 10, and the output node is referred to as a NODE B.

The fifth electric potential V5 is one of two power supply electric potentials applied at the high-voltage circuit (positive power supply electric potential and negative power supply electric potential), while the sixth electric potential V6 is the other of two power supply electric potentials applied at the high-voltage circuit (positive power supply electric potential and negative power supply electric potential). In this embodiment, the fifth electric potential V5 is a negative power supply electric potential of the high-voltage circuit (referred to as a high-voltage negative power supply electric potential VLL), while the sixth electric potential V6 is a positive power supply electric potential of the high-voltage circuit (referred to as a high-voltage positive power supply electric potential VHH). The output signal includes, as the input signal, at least one of the logic 0 or the logic 1. In this embodiment, the output signal corresponding to the logic 0 is the fifth electric potential V5, or an electric potential that is close to the fifth electric potential V5 and at least acquires the value of the fifth electric potential V5 rather than the average electric potential of the fifth electric potential V5 and the sixth electric potential V6. Likewise, the output signal corresponding to the logic 1 is the sixth electric potential V6, or an electric potential that is close to the sixth electric potential V6 and at least acquires the value of the sixth electric potential V6 rather than the average electric potential of the fifth electric potential V5 and the sixth electric potential V6. The amplitude of the logic signal in the high-voltage circuit (the potential difference between the fifth electric potential V5 and the sixth electric potential V6) is larger than the amplitude of the logic signal in the low-voltage circuit (the potential difference between the first electric potential V1 and the second electric potential V2), and is mostly from about 5 V to 50 V at the electro-optical apparatus. In this embodiment, as an example, the amplitude of the logic signal in the low-voltage circuit (the potential difference between the first electric potential V1 and the second electric potential V2) is set as 5 V, and the amplitude of the logic signal in the high-voltage circuit (the logic signal with a high amplitude, the potential difference between the fifth electric potential V5 and the sixth electric potential V6) is set as 15.5 V. In addition, in this embodiment, the low-voltage negative electric supply electric potential VSS and the high-voltage negative electric supply electric potential VLL are the same, and both of the electric potentials are the standard electric potentials (VSS=VLL=0 V). Meanwhile, the low-voltage negative electric supply electric potential VSS and the high-voltage negative electric supply electric potential VLL may be different and may not be the standard electric potentials.

As described above, in the buffer unit 13, the middle signal that acquires a value between the third electric potential V3 and the fourth electric potential V4 is converted to an output signal that acquires a value between the fifth electric potential V5 and the sixth electric potential V6. The buffer unit 13 has a logic threshold electric potential Vtrip, and the third electric potential V3 is a value between the logic threshold electric potential Vtrip and the fifth electric potential V5, while the fourth electric potential V4 is a value between the logic threshold electric potential Vtrip and the sixth electric potential V6. Likewise, in the buffer unit 13 is a circuit in which the middle signal that acquires the value of the fifth electric potential V5 rather than the logic threshold electric potential Vtrip (the third electric potential V3) is rendered to be closer to the fifth electric potential V5, while the middle signal that acquires the value of the sixth electric potential V6 rather than the logic threshold electric potential Vtrip (the fourth electric potential V4) is rendered to be closer to the sixth electric potential V6. In this way, in the level shift circuit 10, the amplitude of the input signal that acquires a value between the first electric potential V1 and the second electric potential V2 is correctly converted to the output signal acquires a value between the fifth electric potential V5 and the sixth electric potential V6. The process is as above in a strict sense. However, for the convenience of description hereinafter, the input signal is regarded as acquiring the first electric potential V1 in the case of the logic 0 and acquiring the second electric potential V2 in the case of the logic 1. Likewise, the middle signal is regarded as acquiring the third electric potential V3 in the case of the logic 0 and acquiring the fourth electric potential V4 in the case of the logic 1. In addition, the output signal is regarded as acquiring the fifth electric potential V5 in the case of the logic 0 and acquiring the sixth electric potential V6 in the case of the logic 1. Yet, the relationship between the logic 0 and the logic 1 may be opposite. More specifically, in the case of the logic 0, the input signal acquires the second electric potential V2, the middle signal acquires the fourth electric potential V4, and the output signal acquires the sixth electric potential V6. In the case of the logic 1, the input signal acquires the first electric potential V1, the middle signal acquires the third electric potential V3, and the output signal acquires the fifth electric potential V5.

[Circuit Configuration]

Next, the configuration of the level shift circuit 10 will be described with reference to FIG. 1.

As illustrated in the FIG. 1(*a*), between the electric potential converting unit 11 and the wiring in which the input unit IN and the sixth electric potential V6 (in this embodiment, the high-voltage positive power supply electric potential VHH) are provided, and a first conductivity-type transistor T1 and a second conductivity-type transistor T2 are electrically connected in series. In this embodiment, the first conductivity-type transistor T1 is an N-type transistor, while the second conductivity-type transistor T2 is a P-type transistor. More specifically, a source 1S of the N-type first conductivity-type transistor T1 is electrically connected to the input unit IN, and a source 2S of the P-type second conductivity-type transistor T2 is electrically connected to the wiring in which the sixth electric potential V6 (in this embodiment, the high-voltage positive power supply electric potential VHH) is provided. In addition, a drain 1D of the first conductivity-type transistor T1 and a drain 2D of the second conductivity-type transistor T2 are electrically connected to a gate of the first conductivity-type transistor T1 and a gate of the second conductivity-type transistor T2 and become an output node (NODE A) of the electric potential converting unit 11. Yet, as for the sources and drains of the transistors, the one with a low electric potential is the source in the N-type transistor and the one with a high electric potential is the source in the P-type transistor compared to a source electric potential and a drain electric potential. In addition, in this specification, the case in which a terminal 1 and a terminal 2 are electrically connected includes the case in which the terminals 1 and 2 are connected through a resistance element and a switching element rather than being directly connected by a wiring. In other words, even if the electric potential in the terminal 1 and the electric potential in the terminal 2 are different to some extent, the terminals 1 and 2 are electrically connected in the case where the meanings of the above cases are the same on the circuit. Therefore, for example, also in the case where the switching element for stopping or functionalizing the electric potential converting unit 11 is installed between the source 2S of the second conductivity-type transistor T2 and the sixth electric potential V6 (in this embodiment, the high-voltage positive power supply electric potential VHH), if the switching element is turned on, the source 2S of the second conductivity-type transistor T2 and the sixth electric potential V6 (in this embodiment, the high-voltage positive power supply electric potential VHH) enters a conduction state, and thus both of the source 2S and the sixth electric potential V6 are electrically connected.

Since the electric potential converting unit 11 is configured as above, it is possible to convert the first electric potential V1 to the third electric potential V3 and convert the second electric potential V2 to the fourth electric potential V4 by a simple circuit configuration with two transistors. The electric potential (electric potential of the middle signal) of the output node of the electric potential converting unit 11 (NODE A) is a drain electric potential in which a source drain current of the first conductivity-type transistor T1 and the source drain current of the second conductivity-type transistor T2 become the same as each other. For this, the third electric potential V3 becomes a value between the first electric potential V1 and the sixth electric potential V6, while the fourth electric potential V4 becomes a value between the second electric potential V2 and the sixth electric potential V6. In addition, for the level shift circuit 10 to correctly function, it is required for the third electric potential V3 and the fourth electric potential V4 to narrow the logic threshold electric potential Vtrip of the buffer unit 13. However, since the electric potential converting unit 11 is configured as above, it is possible for the third electric potential V3 and the fourth electric potential V4 to easily narrow the logic threshold electric potential Vtrip of the buffer unit 13. This is because, since the size of the first conductivity-type transistor T1 (a channel length L and a channel width W of the first conductivity-type transistor T1) and the size of the second conductivity-type transistor T2 (a channel length L and a channel width W of the second conductivity-type transistor T2) are adjusted, each source drain current can be adjusted, and thus the value of the drain electric potential (the values of the third electric potential V3 and the fourth electric potential V4) can be easily controlled.

In order to increase the response speed of the level shift circuit 10, it is preferable that the source drain current of the first conductivity-type transistor T1 and the second conductivity-type transistor T2 is large. For example, if the channel width W of these transistors is extended and the channel length L is shortened, the response speed is increased. However, if this method is used, the through-current in the electric potential converting unit 11 (current generated between the sixth electric potential V6 and the first electric potential V1 or the second electric potential V2 through the first conductivity-type transistor T1 and the second conductivity-type transistor T2) becomes large, and thus the power consumption is increased. Therefore, it cannot be said that it is advisable to uselessly increase the source drain current of the first conductivity-type transistor T1 and the second conductivity-type transistor T2. Accordingly, in the level shift circuit 10, the capacitor 12 is formed between the NODE A and the input unit IN. In other words, the capacitor 12 includes a first electrode 1Ed and a second electrode 2Ed, and the first electrode 1Ed is electrically connected with the input unit IN and the second electrode 2Ed is electrically connected with the output node of the electric potential converting unit 11. While the details thereof will be described hereinafter, it is possible for the capacitor 12 to reflect the input signal with low amplitude in the electric potential of the output node of the electric potential converting unit 11 without delay by capacitive coupling, and thus it is possible to realize a level shift circuit 10 that is capable of performing high-speed operation. In addition, as described in FIG. 1(*a*), since the level shift circuit 10 is small-sized, it is possible to render the occupation area to be small.

In this embodiment, the capacitor 12 is from the third transistor T3, and has a configuration in which, in order to turn on the third transistor T3, the gate of the third transistor T3 constitutes either one of the first electrode 1Ed or the second electrode 2Ed, and the source and the drain of the third transistor T3 constitute either one of the first electrode 1Ed or the second electrode 2Ed. More specifically, the third transistor T3 is an N-type. The source and the drain of the third transistor T3 and the input unit IN are electrically connected, and the node of the third transistor T3 and the NODE A are electrically connected. As a result, the first electrode 1Ed of the capacitor 12 becomes a channel forming area of the third transistor T3, and the second electrode 2Ed of the capacitor 12 becomes a gate of the third transistor T3. In this embodiment, the sixth electric potential V6 is the high-voltage positive power supply electric potential VHH, and thus the electric potential of the middle signal must be higher than the electric potential of the input signal. Therefore, the gate electric potential becomes higher than the source electric potential of the third transistor T3, and thus the N-type third transistor T3 can be turned on.

If the third transistor T3 of the capacitor 12 becomes turned on, a depletion layer capacity is not generated and the gate capacity of the transistor can be used as itself as the capacity of the capacitor 12. Therefore, even if the capacitor 12 is formed at the third transistor T3 with a small area by being able to obtain a relatively large capacity, it is possible to sufficiently function as a capacity. In addition, if the third transistor T3 is used in the capacitor 12, a special process addition or a special layout is not required for establishing the capacitor 12. Therefore, by increasing the degree of freedom in a circuit design and by a simple production process the same as a normal process, it is possible to realize a level shift circuit 10 with the small occupation area and capable of performing high-speed operation. In this embodiment, the third transistor T3 is used in the capacitor 12. However, the capacitor 12 may be a common capacity element that includes the first electrode 1Ed of a conductor, the second electrode 2Ed of the conductor, and a dielectric interposed between the first electrode 1Ed and the second electrode 2Ed.

In the buffer unit 13, a first inverter INV1 and a second inverter INV2 become a first buffer 131 by being electrically connected in series between the input node (NODE A) of the buffer unit 13 and the output node (NODE B) of the buffer unit 13. By this, it is possible to configure the buffer unit 13 in a simple configuration of two inverters. In addition, it is possible to render the third electric potential V3 and the fourth electric potential V4 which are electric potentials close to a middle value between the fifth electric potential V5 and the sixth electric potential V6 to be approximately the fifth electric potential V5 and the sixth electric potential V6 in the output unit OUT.

Meanwhile, in the case of the above configuration, the logic threshold electric potential Vtrip of the buffer unit 13 becomes the logic threshold electric potential Vtrip of the first inverter INV1. The logic threshold electric potential Vtrip of the first inverter INV1 is an electric potential in which an inverter distinguishes the logic 1 and the logic 0. In other words, if the input towards the inverter has a higher electric potential than the logic threshold electric potential Vtrip, the output from the inverter has a lower electric potential than the logic threshold electric potential Vtrip. If the input towards the inverter has a lower electric potential than the logic threshold electric potential Vtrip, the electric potential that renders the output from the inverter to have a higher electric potential than the logic threshold electric potential Vtrip is the logic threshold electric potential Vtrip of the inverter.

The configuration of the buffer unit 13 is not limited to the above and may be in any form if the buffer unit satisfies the function as a buffer unit described in the above [Circuit function]. In addition, in this embodiment, a second buffer 132 is installed at the rear end of the first buffer 131, and the output from the second buffer 132 (a second output OUT 2) is considered in the verification of the level shift circuit 10. In this way, any number of buffers may be further included at the rear end of the buffer unit 13.

[Verification and Principle]

Figure 2:
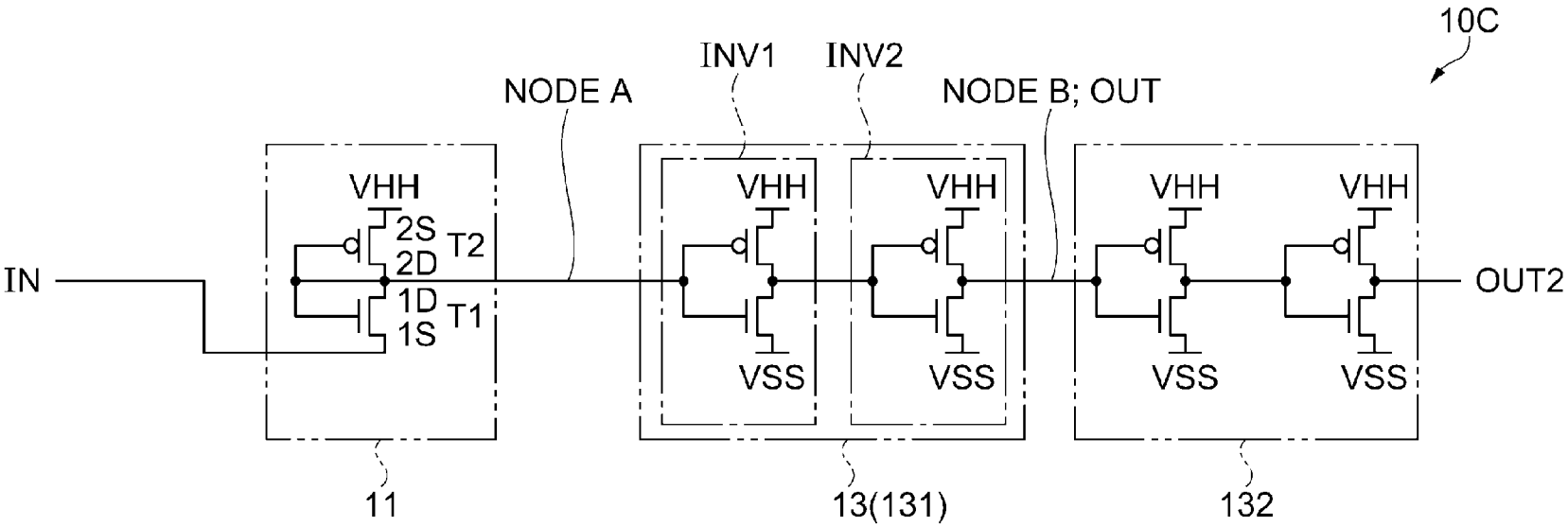
FIG. 2 is a circuit diagram illustrating a level shift circuit which is a comparative example.
Figure 3:
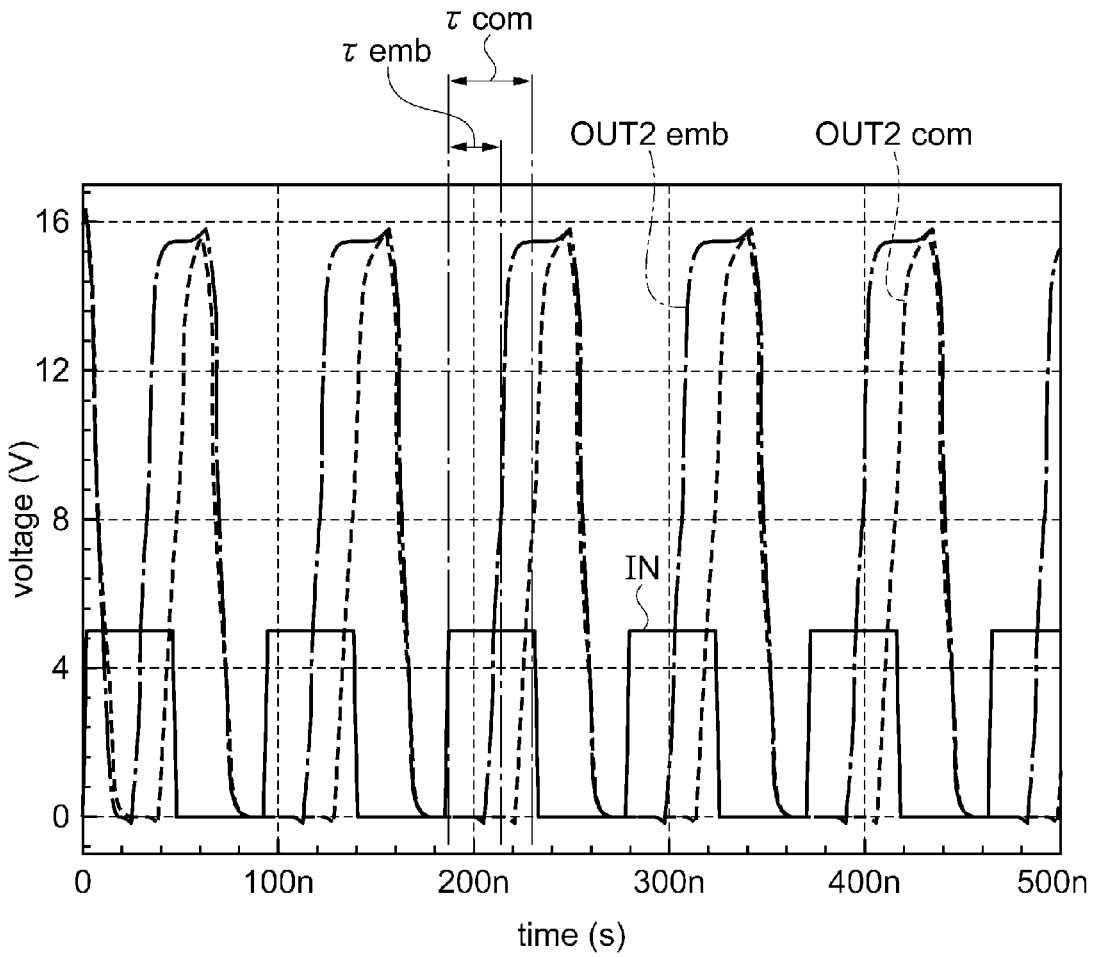
FIG. 3 is a view in which the function of the level shift circuit according to a first embodiment is verified.
Figure 4:
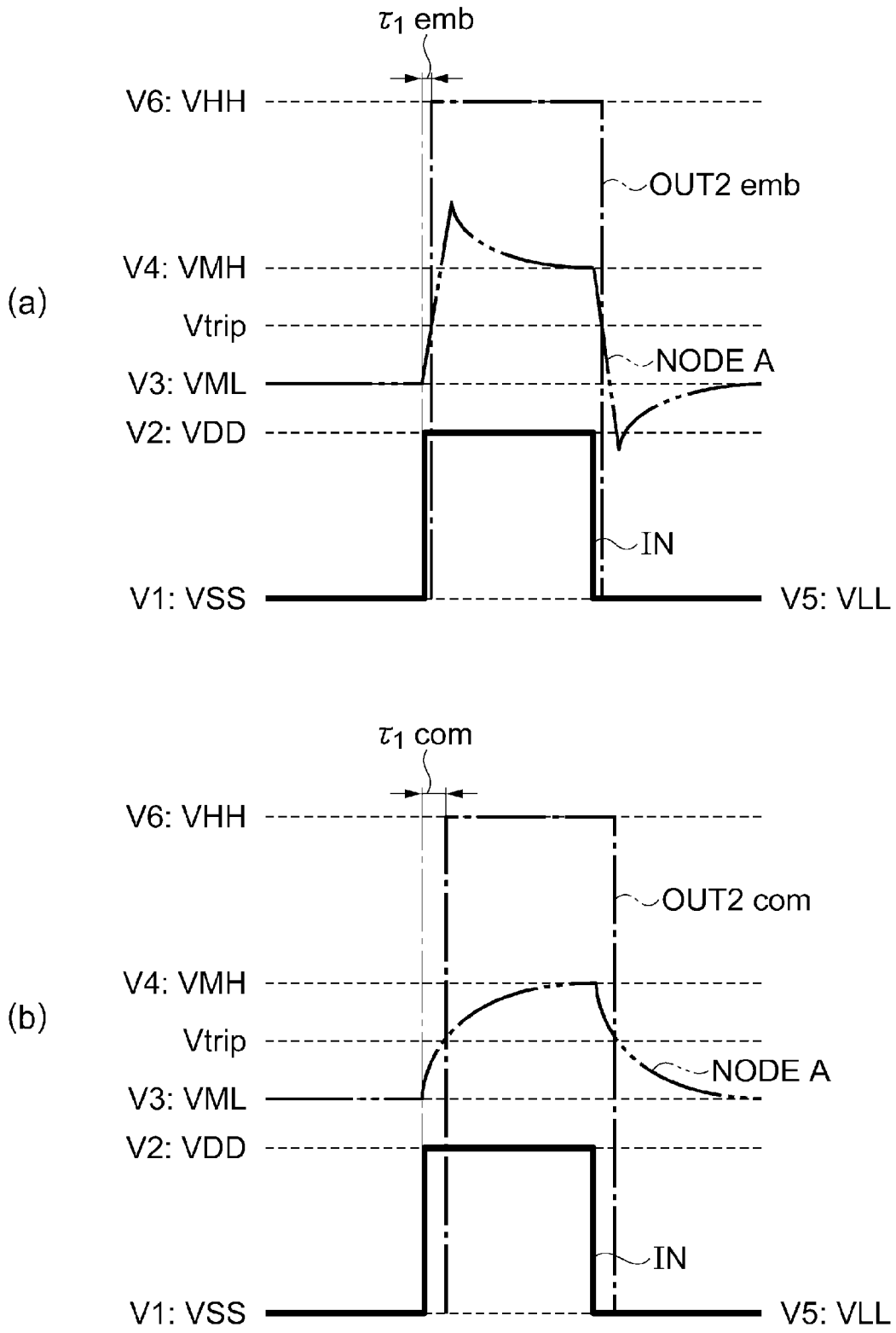
FIG. 4 is a view illustrating the operation principle of a level shift circuit.
Figure 5:
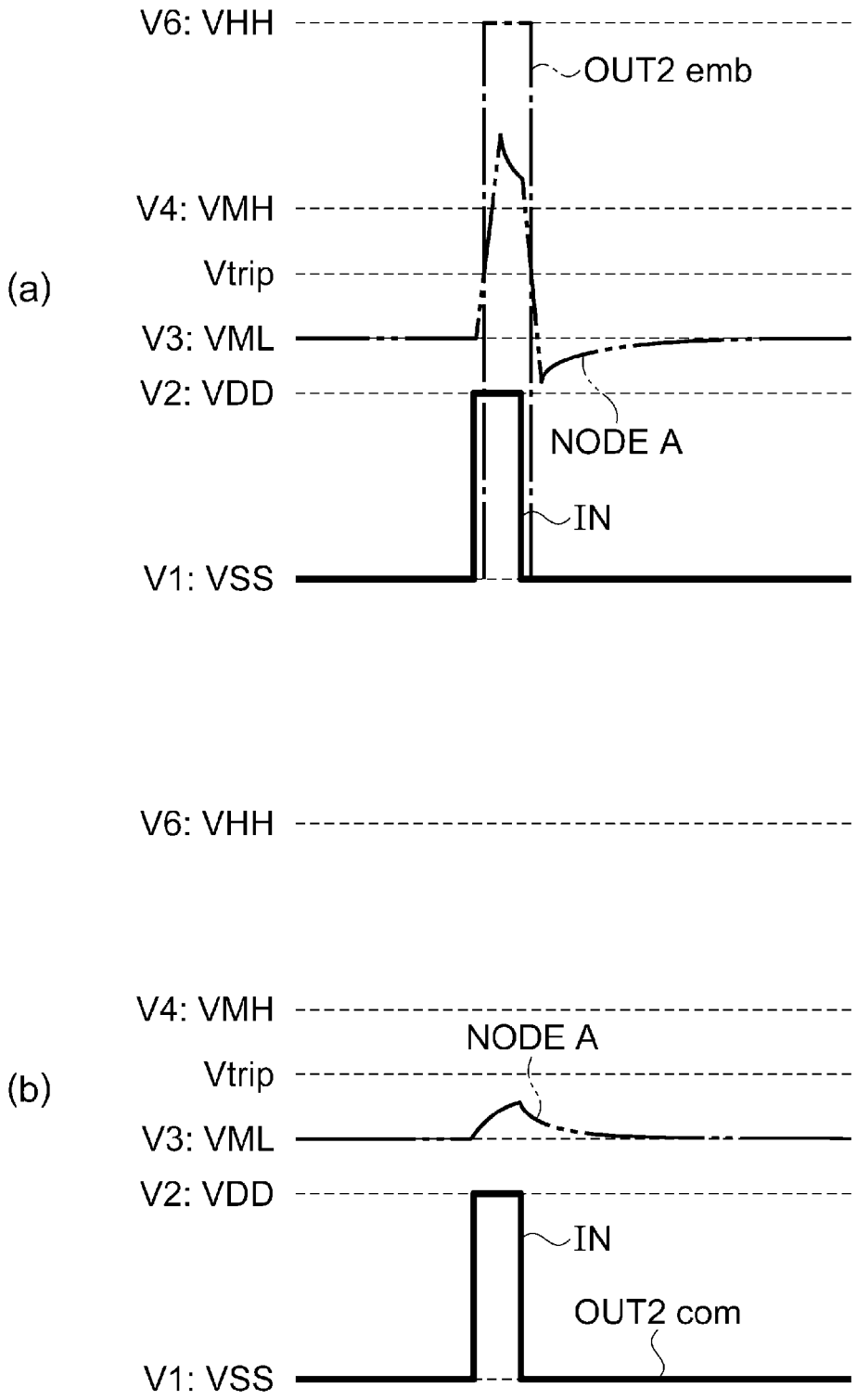
FIG. 5 is a view illustrating the operation principle of the level shift circuit.

FIG. 2 is a circuit diagram illustrating a level shift circuit which is a comparative example. FIG. 3 is a view in which the function of the level shift circuit according to this embodiment is verified. FIG. 4 is a view illustrating the operation principle of the level shift circuit. FIG. 4(*a*) illustrates the level shift circuit according to this embodiment, while FIG. 4(*b*) illustrates the level shift circuit of the comparative example. FIG. 5 is a view illustrating the operation principle of the level shift circuit. FIG. 5(*a*) illustrates the level shift circuit according to this embodiment, while FIG. 5(*b*) illustrates the level shift circuit of the comparative example. Next, with reference to FIG. 2 to FIG. 5, the function of the level shift circuit 10 according to this embodiment will be verified and the principle thereof will be described. Furthermore, In FIG. 2, a level shift circuit 10C according to the comparative example is illustrated. However, for the description to be easily understood, the same configuration part in both the comparative example and this embodiment will be described by using a same symbol.

As illustrated in FIG. 2, in the level shift circuit 10C of the comparative example, the capacitor 12 is removed from the level shift circuit 10 of this embodiment illustrated in FIG. 1. As a result, an input unit IN towards the level shift circuit 10C is the same as one source 1S of the first conductivity-type transistor T1.

In FIG. 3, the function of the level shift circuit 10 is verified. The horizontal axis illustrates time while the vertical axis illustrates an electric potential. The input signal is a square wave with an amplitude of 5 V and is illustrated as [IN] in FIG. 3. In addition, output from the second buffer 132 of the level shift circuit 10 according to this embodiment (a second output OUT2) is illustrated as [OUT2 emb] in FIG. 3. Output from the second buffer 132 of the level shift circuit 10C corresponding to FIG. 2 according to the comparative example (a second output OUT2) is illustrated as [OUT2 com] in FIG. 3. It is known that the delay time of the second output OUT2 emb of the level shift circuit 10 according to this embodiment (referred to as an embodiment delay time τemb) is shorter than the delay time of the second output OUT2 com of the level shift circuit 10C according to the comparative example (referred to as a comparative example delay time τcom) and the level shift circuit 10 performs high-speed operation.

The duty ratio of the input signal illustrated in FIG. 3 (ratio of the period of the low-voltage negative power supply electric potential VSS to the period of the low-voltage positive power supply electric potential VDD) is 1:1. The duty ratio at the second output OUT2 of the level shift circuit 10C of the comparative example (ratio of the period of the high-voltage negative power supply electric potential VLL to the period of the high-voltage positive power supply electric potential VHH) has a short period of the high-voltage positive power supply electric potential VHH and a long period of the high-voltage negative power supply electric potential VLL, and thus the duty ratio thereof is not correctly maintained. In contrast, the duty ratio at the second output OUT2 of the level shift circuit 10 according to this embodiment is about 1:1, and it is understood that the duty ratio is maintained to correctly perform amplitude conversion.

Next, with reference to FIG. 4 to FIG. 5, the fact that the level shift circuit 10 according to this embodiment performs high-speed operation and hardly malfunctions will be described. Furthermore, in FIG. 4 and FIG. 5, the input signal is illustrated as [IN], the middle signal is illustrated as [NODE A], and the second output OUT2 is illustrated as [OUT2 emb] or as [OUT2 com].

In the level shift circuit 10 according to this embodiment, as illustrated in FIG. 1(*a*), the input unit IN is electrically connected to the source 1S of the first conductivity-type transistor T1, which is a part of the electric potential converting unit 11, and the first electrode 1Ed of the capacitor 12. For this, as illustrated in FIG. 4(*a*), if the input signal changes from the low-voltage negative power supply electric potential VSS to the low-voltage positive power supply electric potential VDD, the electric potential of the NODE A responds without delay by the capacitive coupling of the capacitor 12. In other words, as illustrated in the NODE A of FIG. 4(*a*), the electric potential of the middle signal rapidly increases right after the input signal is changed and exceeds the logic threshold electric potential Vtrip of the buffer unit 13 in a short period of time. In the level shift circuit 10, the delay time from the time when the input signal is changed to the time when the electric potential of the middle signal exceeds the logic threshold electric potential Vtrip of the buffer unit 13 is referred to as an embodiment first delay time $\tau_1$emb. After that, the electric potential of the middle signal becomes gradually mitigated to be the fourth electric potential 4 (=VMH), which is the electric potential established by the conductance of the first conductivity-type transistor T1 and the conductance of the second conductivity-type transistor T2. With regard to this, in the level shift circuit 10C of the comparative example, as illustrated in FIG. 4(*b*), when the input signal changes from the low-voltage negative power supply electric potential VSS to the low-voltage positive power supply electric potential VDD, the electric potential of the middle signal is gradually increased to be the fourth electric potential 4 (=VMH) with a time constant that is established by the conductance of the first conductivity-type transistor T1, the conductance of the second conductivity-type transistor T2, and the load capacity of the first inverter INV1 and exceeds the logic threshold electric potential Vtrip of the buffer unit 13 in a short time. In the level shift circuit 10C of the comparative example, the delay time from the time when the input signal is changed to the time when the electric potential of the middle signal exceeds the logic threshold electric potential Vtrip of the buffer unit 13 is referred to as a comparative example first delay time $\tau_1$com. In this way, the embodiment first delay time $\tau_1$emb is shorter than the comparative example first delay time $\tau_1$com, and the difference between the delay times becomes the difference between an embodiment delay time τemb and an comparative example first delay time τcom illustrated in FIG. 3.

In the level shift circuit 10, since capacitive coupling of the input signal by the capacitor 12 is used, the changed amount of the prompt electric potential at the NODE A when the input signal is changed is determined by the ratio of the capacity of the capacitor 12 to the other capacity associated with the NODE A (the sum of the transistor capacity of the first conductivity-type transistor T1, the transistor capacity of the second conductivity-type transistor T2, the capacity of the first inverter INV1, and a parasitic capacity). Therefore, as illustrated in FIG. 4(*a*), it is preferable to set the capacity of the capacitor 12 (in this embodiment, the size of the third transistor T3) such that the maximum electric potential by the capacitive coupling of the middle signal is higher than the fourth electric potential V4.

The same principle is applied when the input signal is changed from the low-voltage positive power supply electric potential VDD to the low-voltage negative power supply electric potential VSS. As an effect of the capacitive coupling, the electric potential of the NODE A rapidly responds and then becomes mitigated to be the third electric potential V3. By this principle, the high-speed operation at the level shift circuit 10 is realized.

The fact that the level shift circuit 10 according to this embodiment hardly malfunctions can also be described with the same principle. As described in FIG. 5(*a*), in the case where the frequency of the input signal is high (in FIG. 5, this is described by shortening the period of the low-voltage positive power supply electric potential VDD of the input signal), the electric potential of the NODE A rapidly responds by the capacitive coupling of the capacitor 12, and thus the second output OUT2 emb can also be correctly output from the level shift circuit 10. With regard to this, as described in FIG. 5(*b*), in the level shift circuit 10C of the comparative example, the electric potential of the middle signal gradually increases. For this, in the case where the frequency of the input signal is high, a situation where the input signal is replaced occurs before the electric potential of the middle signal exceeds the logic threshold electric potential Vtrip of the buffer unit 13. In such case, the second output OUT2 com from the level shift circuit 10C of the comparative example generally stops at the high-voltage negative power supply electric potential VLL and malfunctions. In this way, in the level shift circuit 10 of this embodiment, even if operation speed increases, the level shift circuit hardly malfunctions.

[Electro-Optical Apparatus]

Figure 6:
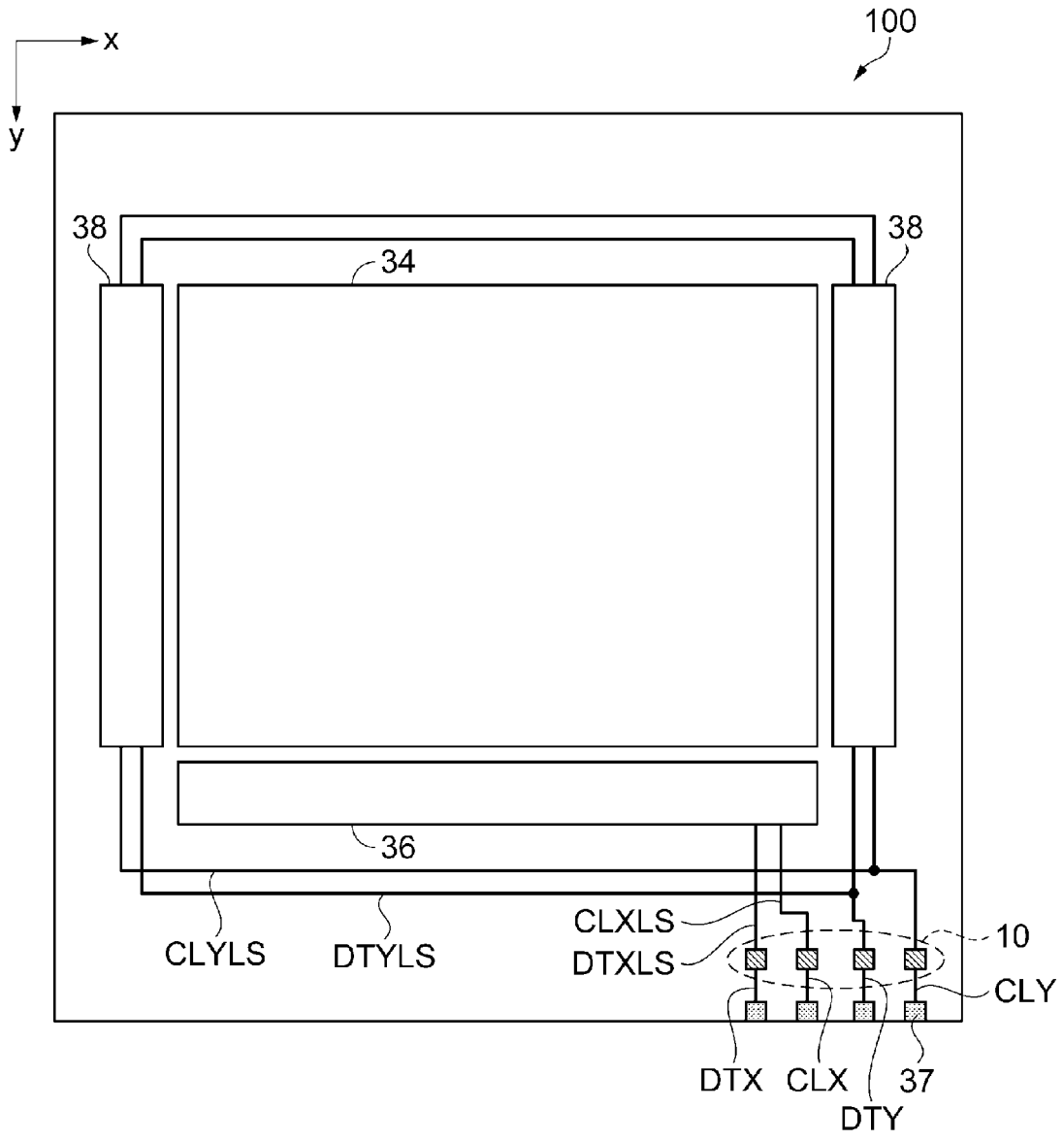
FIG. 6 is a schematic plane diagram illustrating the configuration of a circuit block of the electro-optical apparatus according to the first embodiment.

FIG. 6 is a schematic plane diagram illustrating the configuration of a circuit block of the electro-optical apparatus according to the first embodiment. Hereinafter, the circuit block configuration of the electro-optical apparatus will be described with reference to FIG. 6.

The level shift circuit 10 described above is applied to an electro-optical apparatus or the like. An example of the electro-optical apparatus is a liquid crystal device 100, which is an active-matrix electro-optical apparatus using a thin film transistor element (TFT element) 46 as a switching element of a pixel 35 (refer to FIG. 8). As illustrated in FIG. 6, the liquid crystal device 100 at least includes a display area 34, a signal line driving circuit 36, scanning line driving circuits 38, outer connection elements 37, and the level shift circuit 10. The signal line driving circuit 36, the scanning line driving circuits 38, the outer connection elements 37, and the level shift circuit 10 are configured by the TFT element 46.

In the display area 34, the pixel 35 is installed in a matrix shape. The pixel 35 is an area designated by scanning lines 16 (refer to FIG. 8) and signal lines 17 (refer to FIG. 8) crossed with each other. One pixel 35 is an area from a single scanning line 16 to the adjacent scanning line 16, and from a single signal line 17 to the adjacent signal line 17. In the area outside the display area 34, the signal line driving circuit 36 and the scanning line driving circuits 38 are formed. The scanning line driving circuits 38 are formed along the two sides next to the display area 34.

In the outer connection elements 37, an outer control circuit which includes a semiconductor integrated circuit and is not illustrated is electrically connected. The semiconductor integrated circuit is a low-voltage circuit. Therefore, the logic signal provided to the outer connection elements 37 acquires a value between the first electric potential V1 and the second electric potential V2 by a low-amplitude signal. Meanwhile, the logic signal used in the signal line driving circuit 36 and the scanning line driving circuit 38 is a high-amplitude signal and acquires a value between the fifth electric potential V5 and the sixth electric potential V6. For this, in the electro-optical apparatus, the level shift circuit 10 is included for each signal between the outer connection elements 37 and the circuit thereof.

From the outer connection elements 37 to the signal line driving circuit 36, an X-side clock signal CLX and a data DTX or the like for a signal line driving circuit are provided. Likewise, from the outer connection elements 37 to the scanning line driving circuit 38, a Y-side clock signal CLY and a data DTY or the like for a scanning line driving circuit are provided. The level shift circuit 10 is arranged for each signal between the outer connection elements 37 and the signal line driving circuit 36, and between the outer connection elements 37 and the scanning line driving circuit 38. A low-amplitude logic signal provided by the level shift circuit 10 from an outer control circuit is converted to a high-amplitude logic signal. For example, the low-amplitude Y-side clock signal CLY is converted by the level shift circuit 10 into a high-amplitude Y-side clock signal CLYLS, while the low-amplitude data DTY for a scanning line driving circuit is converted by the level shift circuit 10 into a high-amplitude data DTYLS for a scanning line driving circuit. In addition, the low-amplitude X-side clock signal CLX is converted by the level shift circuit 10 into a high-amplitude X-side clock signal CLXLS, while the low-amplitude data DTX for a signal line driving circuit is converted by the level shift circuit 10 into a high-amplitude data DTYLS for a signal line driving circuit. This is applied the same to other signals as well. Furthermore, in FIG. 6, not all of the wirings and all of the outer connection elements are drawn. For the description to be easily understood, only representative wiring among the entire wirings is drawn.

Figure 7:
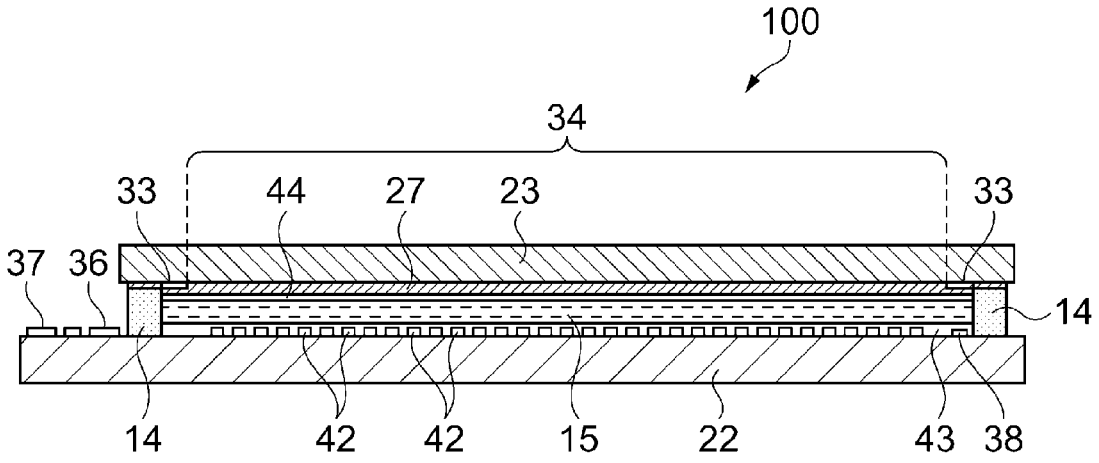
FIG. 7 is a schematic cross-sectional diagram of a liquid crystal device.

FIG. 7 is a schematic cross-sectional diagram of a liquid crystal device. Hereinafter, the cross-sectional structure of the liquid crystal device will be described with reference to FIG. 7. Furthermore, in the following example, a case where an expression of [on the top of X] indicates a case that something is arranged to contact with the top of X, a case where something is arranged on the top of X through other component, or a case where a part of something is arranged so as to contact with the top of X and the part is on the top of X arranged through other component.

In the liquid crystal device 100, an element substrate 22 and an opposite substrate 23 that form one substrate are stuck to a sealing material 14, which is arranged approximately in a shape of a rectangular frame in the planar view. The liquid crystal device 100 is configured to enclose a liquid crystal layer 15 in an area surrounded by the sealing material 14. As for the liquid crystal layer 15, for example, a liquid crystal material that has positive dielectric anisotropy is used. In the liquid crystal device 100, a light shielding film 33 in a shape of a rectangular frame in the planar view, which is made of a light shielding material along the inner peripheral area of the sealing material 14 is formed on the opposite substrate 23, and the area inside the light shielding film 33 is the display area 34. The light shielding film 33, for example, is formed of aluminum (Al), which is a light shielding material, and is further installed opposing the scanning line 16 and the signal line 17 in the display area 34 as described above so as to divide the outer peripheral area of the display area 34 at the opposite substrate 23 side.

As described in FIG. 7, at the liquid crystal layer 15 side of the element substrate 22, a plurality of pixel electrodes 42 are formed, and a first oriented film 43 is formed so as to cover these pixel electrodes 42. The pixel electrodes 42 are conducting films made from a transparent conducting material including ITO (indium tin oxide). Meanwhile, at the liquid crystal layer 15 side of the opposite substrate 23, the light shielding film 33 in a square-block shape is formed, and on the top thereof a shared electrode 27 in a mat plane shape is formed. In addition, on the top of the shared electrode 27, a second oriented film 44 is formed. The shared electrodes 27 is a conducting film made from a transparent conducting material including ITO or the like.

The liquid crystal device 100 is a transmission type, in which polarizing plates (not illustrated) are arranged at the light incidence side and the light extraction side of the element substrate 22 and the opposite substrate 23. In addition, the configuration of the liquid crystal device 100 is not limited to this and may have a reflecting or a semi-transmissive configuration.

Figure 8:
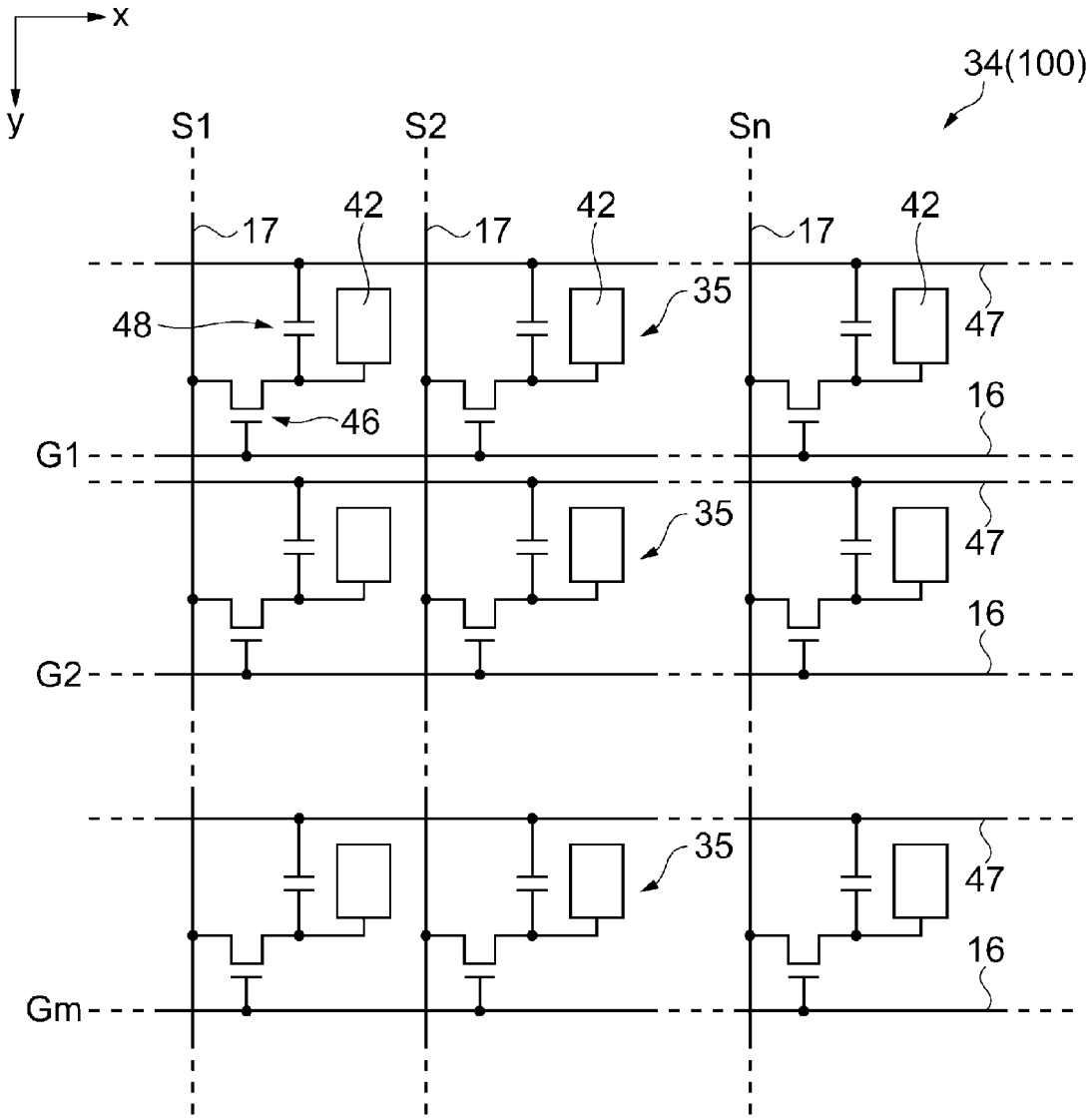
FIG. 8 is an equivalent circuit diagram illustrating the electric configuration of the liquid crystal device.

FIG. 8 is an equivalent circuit diagram illustrating the electric configuration of the liquid crystal device. Hereinafter, the electric configuration of the liquid crystal device will be described with reference to FIG. 8.

As illustrated in FIG. 8, the liquid crystal device 100 includes a plurality of pixels 35 that configures the display area 34. In each of the pixels 35, a pixel electrode 42 is arranged. In addition, in the pixel 35, a TFT element 46 is formed.

The TFT element 46 is a switching element that performs electrifying control towards the pixel electrode 42. At the side of the source of the TFT element 46, the signal line 17 is electrically connected. In each of the signal lines 17, for example, image signals S1, S2 to Sn are provided from the signal line driving circuit 36.

In addition, at the side of the gate of the TFT element 46, the scanning line 16 is electrically connected. In the scanning line 16, for example, scanning signals G1, G2 to Gm are provided from the scanning line driving circuit 38 by a pulsing method at a predetermined timing. In addition, at the side of the drain of the TFT element 46, the pixel electrode 42 is electrically connected.

By the scanning signals G1, G2 to GM provided from the scanning line 16, the TFT element 46, which is a switching element, is turned on for a certain period of time, and thus the image signals S1, S2 to Sn provided from the signal line 17 are written at the pixel 35 through the pixel electrode 42 at a predetermined timing.

The image signals S1, S2 to Sn of the predetermined electric potential written at the pixel 35 is maintained for a certain period of time at a liquid crystal capacity that is formed between the pixel electrode 42 and the shared electrode 27 (refer to FIG. 7). Furthermore, in order to control the electric potential of the maintained image signals S1, S2 to Sn not to decrease due to a leakage current, a maintaining capacity 48 is formed at the pixel electrode 42 and a capacity line 47.

If a voltage signal is applied to the liquid crystal layer 15, by the applied voltage level, the orientation state of the liquid crystal molecules is changed. By this, the light incident on the liquid crystal layer 15 is modulated to generate image light.

Furthermore, in this embodiment, the liquid crystal device 100 is used to describe the electro-optical apparatus. However, examples of the electro-optical apparatuses also include an electrophoresis displaying device, an organic EL device, and the like. In addition, in this embodiment, the level shift circuit 10 is configured by the TFT element 46. However, the level shift circuit 10 may be configured by a semiconductor integrated circuit (IC circuit) formed at a semiconductor substrate. Examples of the semiconductor substrates suitable to the level shift circuit include a silicon substrate, a silicon carbide substrate, and the like.

[Electronic Equipment]

Figure 9:
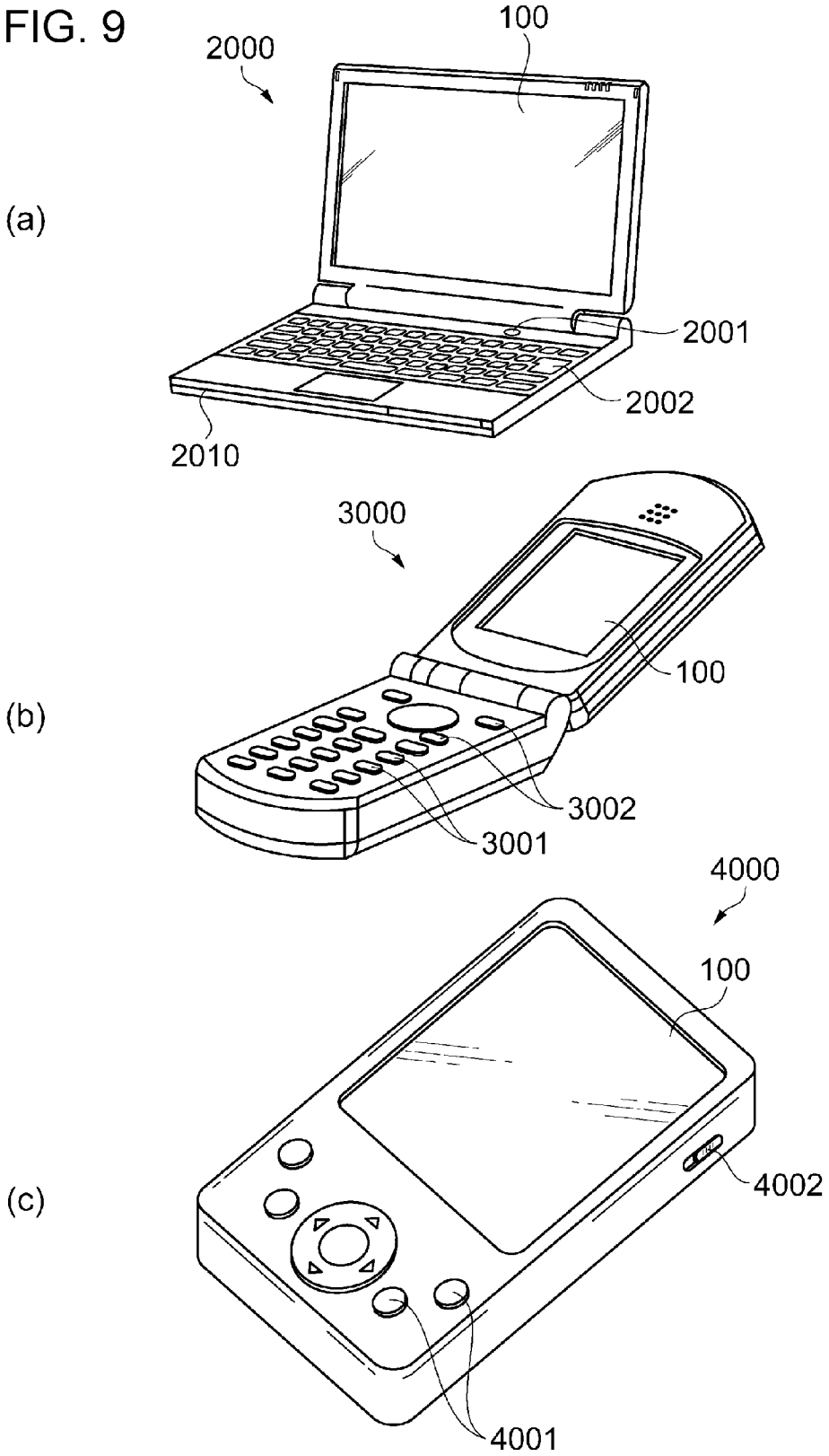
FIG. 9 is a view illustrating an electronic equipment according to the first embodiment.

FIG. 9 is a view illustrating an electronic equipment according to this embodiment. Next, the electronic equipment of this embodiment herein will be described with reference to FIG. 9. FIGS. 9(*a*) to 9(*c*) are schematic views illustrating the configuration of the electronic equipment including the above-described liquid crystal device.

As illustrated in FIG. 9(*a*), a mobile-type personal computer 2000 provided with the liquid crystal device 100 includes the liquid crystal device 100 and a main body unit 2010. In the main body unit 2010, a power switch 2001 and a keyboard 2002 are installed.

Next, as illustrated in FIG. 9(*b*), a cellular phone 3000 provided with the liquid crystal device 100 includes a plurality of operation buttons 3001 and scroll buttons 3002 along with the liquid crystal device 100 as a display unit. By operating the scroll button 3002, the screen displayed on the liquid crystal device 100 can be scrolled.

Next, as illustrated in FIG. 9(*c*), a portable information terminal (PDA: personal digital assistants) 4000 provided with the liquid crystal device 100 includes the plurality of operation buttons 4001 and scroll buttons 4002 along with the liquid crystal device 100 as a display unit. If the operation button 4001 is operated, various pieces of information including an address book and a schedule book are displayed on the liquid crystal device 100.

Furthermore, examples of the electronic equipment provided with the liquid crystal device 100 can include various pieces of electronic equipment other than those illustrated in FIG. 9, such as a pico projector, a head up display, a smart phone, a head mounted display, a electrical view finder (EVF), a small-sized projector, a mobile computer, a digital camera, a digital video camera, a display, a mounting device, an audio device, an exposure device, or a lighting device.

As described above, according to this embodiment, the effect illustrated in the following can be obtained. First, it is possible to realize a level shift circuit 10 with the small occupation area and which is capable of performing high-speed operation. As a result, it is possible to realize an electro-optical apparatus that narrows a peripheral area at the outer boundary of the display area 34 and performs high-speed driving. In other words, it is possible to render an electro-optical apparatus with a great ratio of the display area 34 to the entire electro-optical apparatus and with excellent design properties to perform high-definition display. In addition, it is possible to realize an electronic equipment that includes an electro-optical apparatus with excellent design properties and that is capable of performing high-definition display. Furthermore, if the high-speed operation becomes possible, a large amount of information per unit time can be handled, and thus it is possible to deal with a high-definition display.

Second Embodiment

[Example of Changed Capacitor 1]

Figure 10:
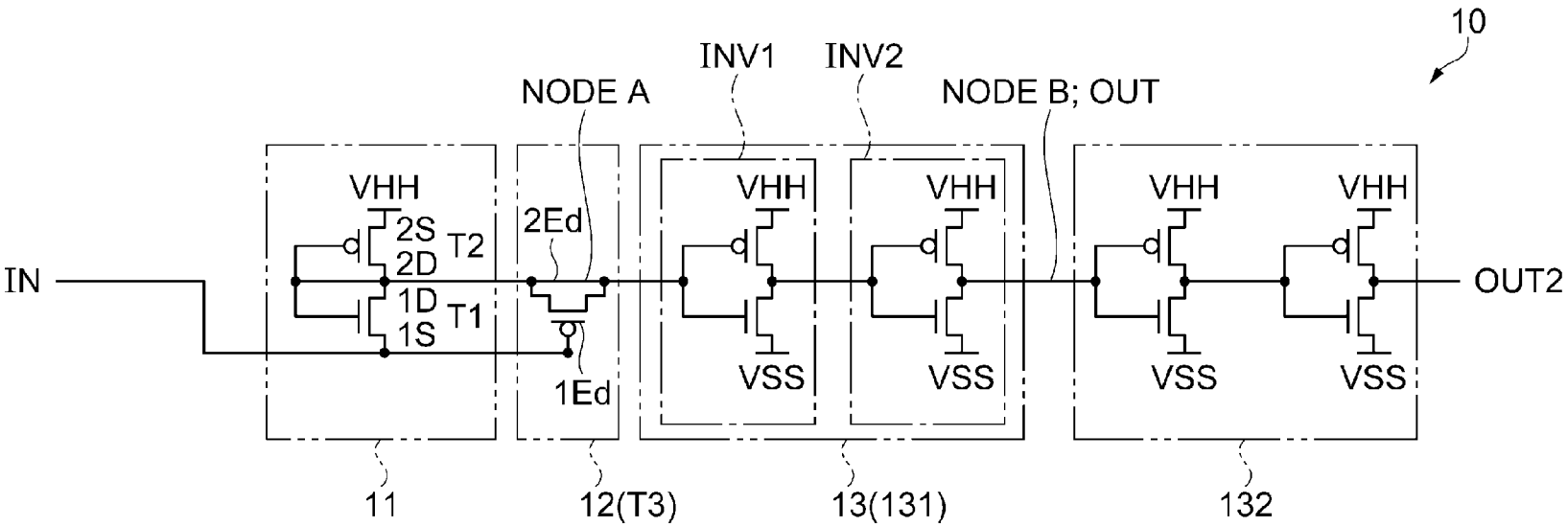
FIG. 10 is a view illustrating a level shift circuit according to a second embodiment.

FIG. 10 is a circuit configuration diagram illustrating a level shift circuit according to the second embodiment. Hereinafter, the configuration of a level shift circuit 10 according to this embodiment will be described with reference to FIG. 10. Furthermore, components the same as those of the first embodiment will be attached with same symbols and overlapping descriptions will be omitted.

Compared to the first embodiment (FIG. 1), in this embodiment (FIG. 10), the conductivity type of the third transistor T3 that constitutes the capacitor 12 is different. The configuration other than this is approximately the same as in the first embodiment. In the first embodiment (FIG. 1), an N-type transistor is used as the third transistor T3. With regard to this, in this embodiment, a P-type transistor is used as the third transistor T3. In order to turn on the P-type third transistor T3, the source and the drain of the P-type third transistor T3 are electrically connected to the NODE A, and the gate of the P-type third transistor T3 is electrically connected to the input unit IN. The configuration other than this is the same as in the first embodiment. Even with this configuration, the same effect as in the first embodiment can be obtained.

Third Embodiment

[Example of Converted Negative Electric Potential]

Figure 11:
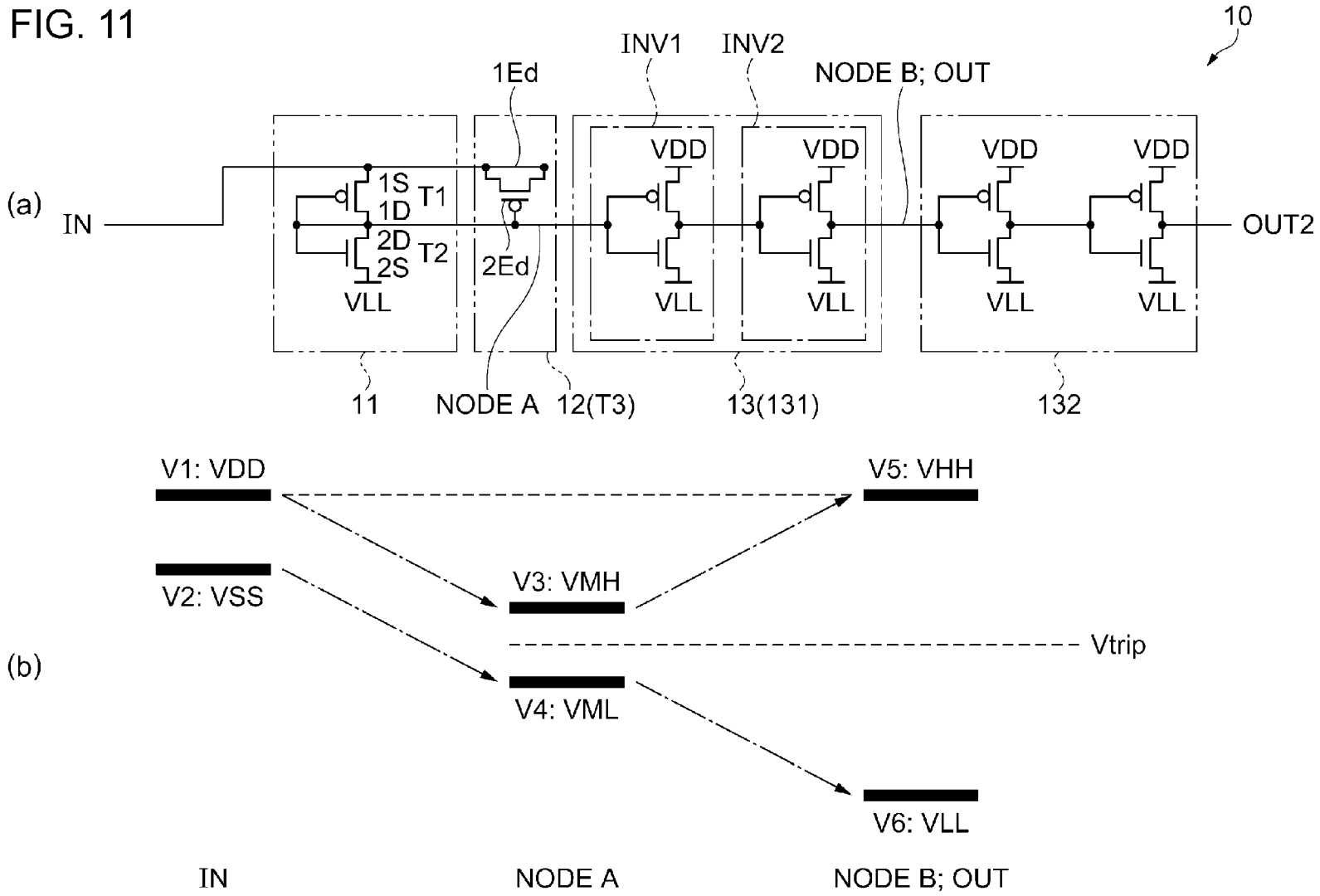
FIG. 11 is a view illustrating a level shift circuit according to a third embodiment.

FIG. 11 is a view illustrating a level shift circuit according to a third embodiment. FIG. 1(*a*) is a circuit configuration diagram and FIG. 1(*b*) is an electric potential relationship diagram. Hereinafter, the function and the configuration of the level shift circuit 10 according to this embodiment will be described with reference to FIG. 11. Furthermore, components the same as those of the first embodiment will be attached with same symbols and overlapping descriptions will be omitted.

Compared to the first embodiment (FIG. 1), in this embodiment (FIG. 11), the conversion form of the electric potential is different. The configuration other than this is approximately the same as in the first embodiment. In the first embodiment (FIG. 1), the negative power supply electric potential at low voltage and high voltage are the same (VSS=VLL) and the positive power supply electric potential is converted. With regard to this, in this embodiment, as described in FIG. 11(*b*), the positive power supply electric potential at low voltage and high voltage are the same (VDD=VHH) and the negative power supply electric potential is converted. Accordingly, the electric connection relationship between the input unit IN and the electric potential converting unit 11 along with the capacitor 12 is changed. The configuration other than this is the same as in the first embodiment.

In this embodiment, as described in FIG. 11(*b*), the first electric potential V1 becomes the low-voltage positive power supply electric potential VDD, the second electric potential V2 becomes the low-voltage positive negative supply electric potential VSS, the third electric potential V3 becomes a medium high electric potential VMH, the fourth electric potential V4 becomes the medium low electric potential VML, the fifth electric potential V5 becomes the high-voltage positive power supply electric potential VHH, and the sixth electric potential V6 becomes the high-voltage negative power supply electric potential VLL. According to such change, the first conductivity-type transistor T1 that configures the electric potential converting unit 11 becomes a P-type, and the second conductivity-type transistor T2 that configures the electric potential converting unit 11 becomes an N-type. In addition, the third transistor T3 that configures the capacitor 12 becomes a P-type. The input unit IN is electrically connected to the source 1S of the first conductivity-type transistor T1 and the first electrode 1Ed (the source and the drain of the third transistor T3). In addition, the gate of the P-type third transistor T3 is electrically connected to the NODE A. As a result, the first electrode 1Ed of the capacitor 12 becomes a channel forming area of the third transistor T3, and the second electrode 2Ed of the capacitor 12 becomes a gate of the third transistor T3. In this embodiment, the sixth electric potential V6 is the high-voltage negative power supply electric potential VLL, and thus the electric potential of the middle signal must be lower than the electric potential of the input signal. Therefore, the gate electric potential becomes lower than the source electric potential of the third transistor T3, and thus the P-type third transistor T3 becomes turned on.

Figure 12:
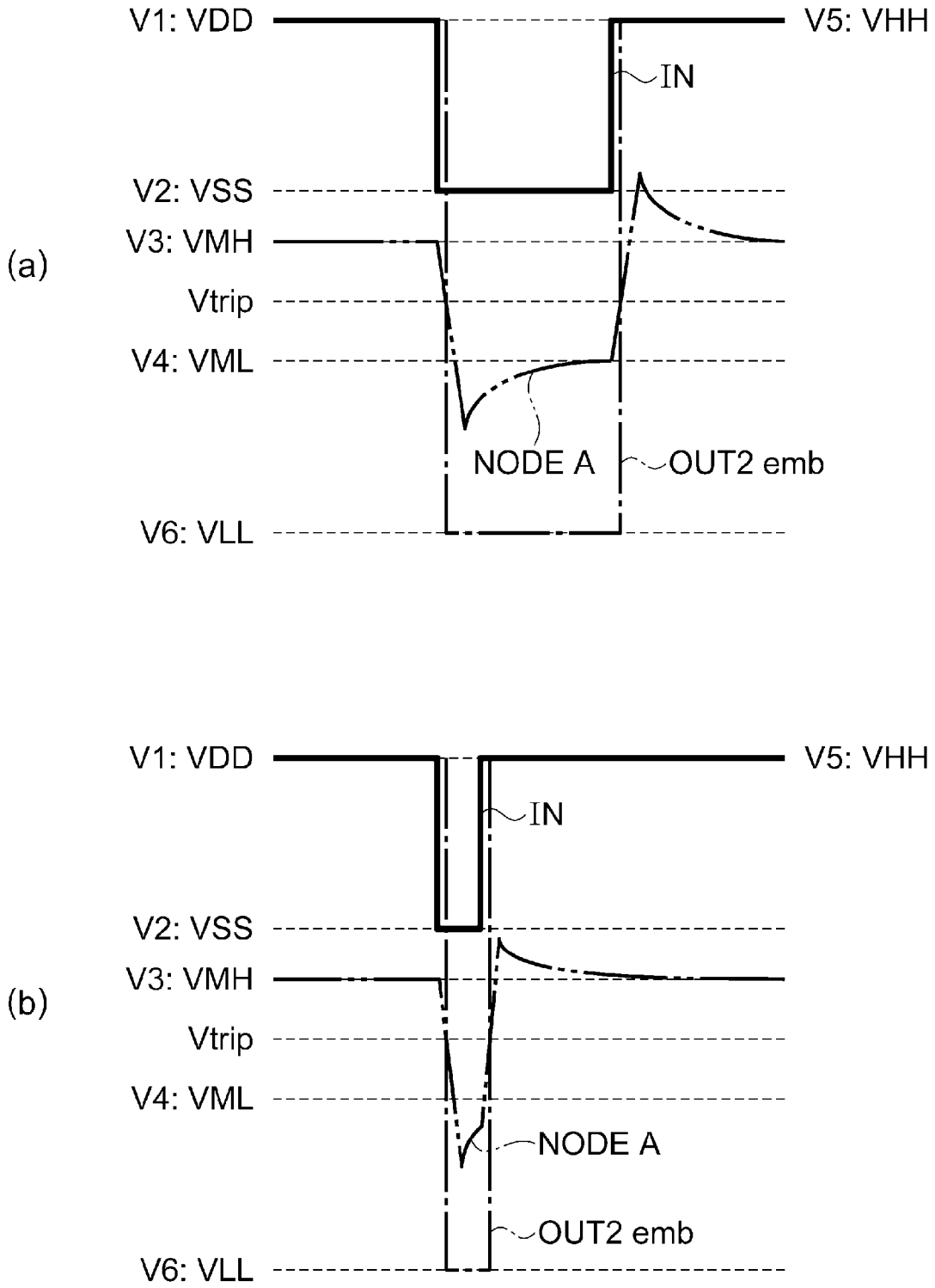
FIG. 12 is a view illustrating the operation principle of the level shift circuit according to the third embodiment.

FIG. 12 is a view illustrating the operation principle of the level shift circuit according to this embodiment. FIG. 12(*a*) illustrates common operation, while FIG. 12(*b*) illustrates high-speed operation. Next, with reference to FIG. 12, the fact that the level shift circuit 10 according to this embodiment performs high-speed operation and hardly malfunctions will be described. Meanwhile, in FIG. 12, the input signal is illustrated as [IN], the middle signal is illustrated as [NODE A], and the second output OUT2 is illustrated as [OUT2 emb].

In the level shift circuit 10 according to this embodiment, as illustrated in FIG. 11(*a*), the input unit IN is electrically connected to the source of the first conductivity-type transistor T1, which is a part of the electric potential converting unit 11, and the first electrode 1Ed of the capacitor 12. For this, as illustrated in FIG. 12(*a*), if the input signal changes from the low-voltage positive power supply electric potential VDD to the low-voltage negative power supply electric potential VSS, the electric potential of the NODE A responds without delay by the capacitive coupling of the capacitor 12. In other words, as illustrated in the NODE A of FIG. 12(*a*), the electric potential of the middle signal rapidly decreases right after the input signal is changed and falls short from the logic threshold electric potential Vtrip of the buffer unit 13 in a short period of time. After that, the electric potential of the middle signal becomes gradually mitigated to be the fourth electric potential 4, which is the electric potential established by the conductance of the first conductivity-type transistor T1 and the conductance of the second conductivity-type transistor T2. In this way, since the electric potential of the middle signal rapidly responds by the capacitive coupling of the capacitor 12, and the level shift circuit 10 performs a high-speed response.

In the level shift circuit 10, since capacitive coupling of the input signal is used by the capacitor 12, the changed amount of the prompt electric potential at the NODE A when the input signal is changed is determined by the ratio of the capacity of the capacitor 12 to the other capacity associated with the NODE A (the sum of the transistor capacity of the first conductivity-type transistor T1, the transistor capacity of the second conductivity-type transistor T2, the capacity of the first inverter INV1, and a parasitic capacity). Therefore, as illustrated in FIG. 12(*a*), it is preferable to set the capacity of the capacitor 12 (in this embodiment, the size of the third transistor T3) such that the minimum electric potential by the capacitive coupling of the middle signal is lower than the fourth electric potential V4.

The same principle is applied when the input signal is changed from the low-voltage negative power supply electric potential VSS to the low-voltage positive power supply electric potential VDD. As an effect of the capacitive coupling, the electric potential of the NODE A rapidly responds and then becomes mitigated to be the third electric potential V3. By this principle, the high-speed operation at the level shift circuit 10 is realized.

The fact that the level shift circuit 10 according to this embodiment hardly malfunctions can also be described with the same principle. As described in FIG. 12(*b*), in the case where the frequency of the input signal is high (in FIG. 12(*b*), this is described by shortening the period of the low-voltage negative power supply electric potential VSS of the input signal), the electric potential of the NODE A rapidly responds by the capacitive coupling of the capacitor 12, and thus the second output OUT2 emb can also be correctly output from the level shift circuit 10. In this way, in the level shift circuit 10 of this embodiment, even if operation speed is increased, the level shift circuit hardly malfunctions.

Fourth Embodiment

[Example of Changed Capacitor 2]

Figure 13:
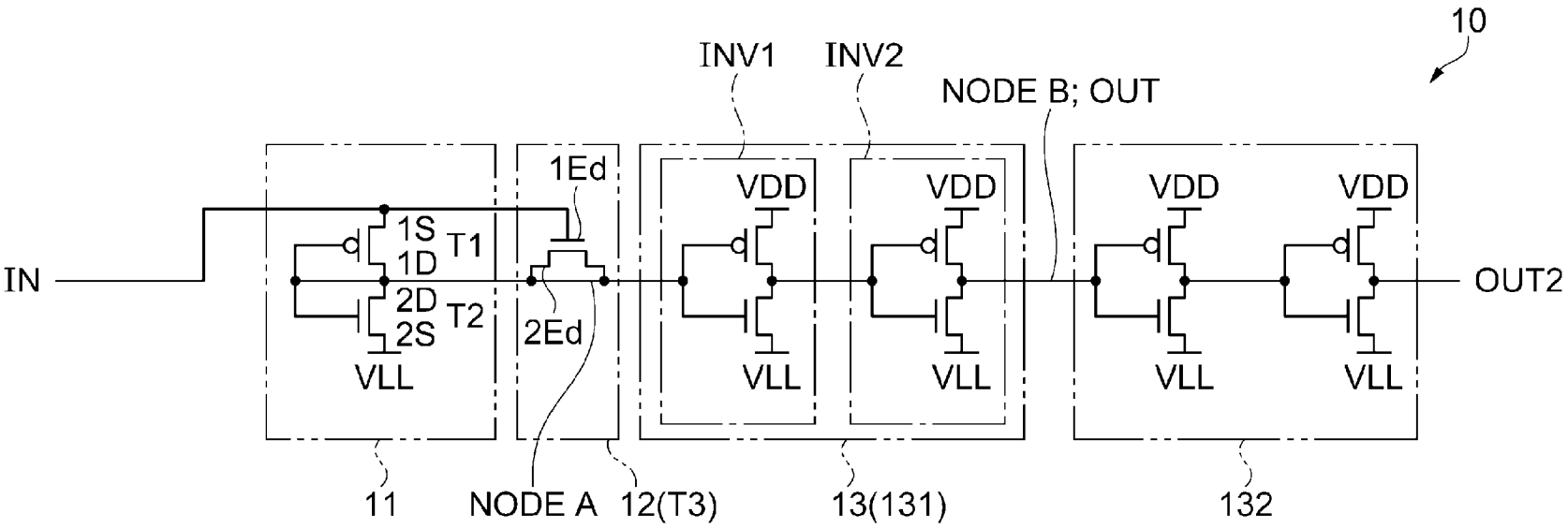
FIG. 13 is a view illustrating a level shift circuit according to a fourth embodiment.

FIG. 13 is a view illustrating a level shift circuit according to a fourth embodiment. Hereinafter, the configuration of a level shift circuit 10 according to this embodiment will be described with reference to FIG. 13. Furthermore, components the same as those of the third embodiment will be attached with same symbols and overlapping descriptions will be omitted.

Compared to the third embodiment (FIG. 11), in this embodiment (FIG. 13), the conductivity type of the third transistor T3 that constitutes the capacitor 12 is different. The configuration other than this is approximately the same as in the third embodiment. In the third embodiment (FIG. 11), a P-type transistor is used as the third transistor T3. With regard to this, in this embodiment, an N-type transistor is used as the third transistor T3. In order to turn on the N-type third transistor T3, the source and the drain of the N-type third transistor T3 are electrically connected to the NODE A, and the gate of the N-type third transistor T3 is electrically connected to the input unit IN. The configuration other than this is the same as in the third embodiment. Even with this configuration, the same effect as in the third embodiment can be obtained.

Fifth Embodiment

[Example of Changed Capacitor 3]

Figure 14:
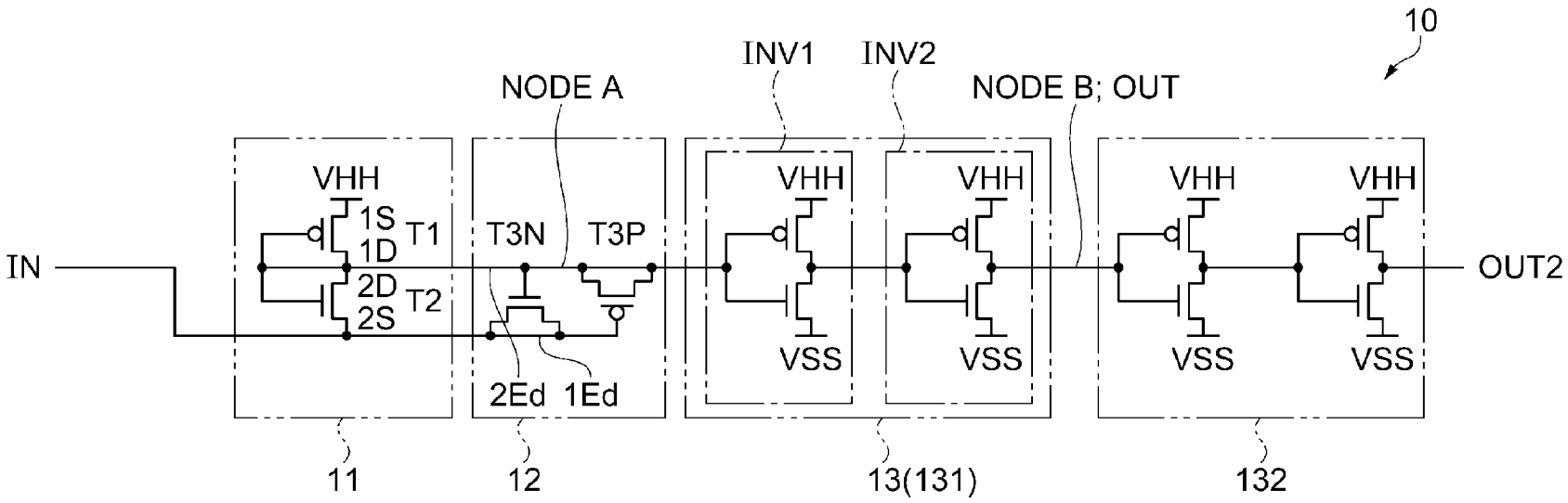
FIG. 14 is a view illustrating a level shift circuit according to a fifth embodiment.

FIG. 14 is a circuit configuration diagram illustrating a level shift circuit according to the fifth embodiment. Hereinafter, the configuration of a level shift circuit 10 according to this embodiment will be described with reference to FIG. 14. Furthermore, components the same as those of the first embodiment will be attached with same symbols and overlapping descriptions will be omitted.

Compared to the first embodiment (FIG. 1), in this embodiment (FIG. 14), the form of the third transistor T3 that constitutes the capacitor 12 is different. The configuration other than this is approximately the same as in the first embodiment. In the first embodiment (FIG. 1), an N-type transistor is used as the third transistor T3. With regard to this, in this embodiment, an N-type transistor and a P-type transistor are used as the third transistor T3. The arrangement of an N-type third transistor T3N is the same as in the first embodiment. In addition, a P-type third transistor T3P is installed, and to turn on the transistor, the source and the drain of the P-type third transistor T3P are electrically connected to the NODE A, and the gate of the P-type third transistor T3P is electrically connected to the input unit IN. Therefore, the first electrode 1Ed of the capacitor 12 becomes the channel forming area of the N-type third transistor T3N and the gate of the P-type third transistor T3P, and the second electrode 2Ed of the capacitor 12 becomes the gate of the N-type third transistor T3N and the channel forming area of the P-type third transistor T3P. The configuration other than this is the same as in the first embodiment. Even with this configuration, the same effect as in the first embodiment can be obtained.

Sixth Embodiment

[Example of Changed Capacitor 4]

Figure 15:
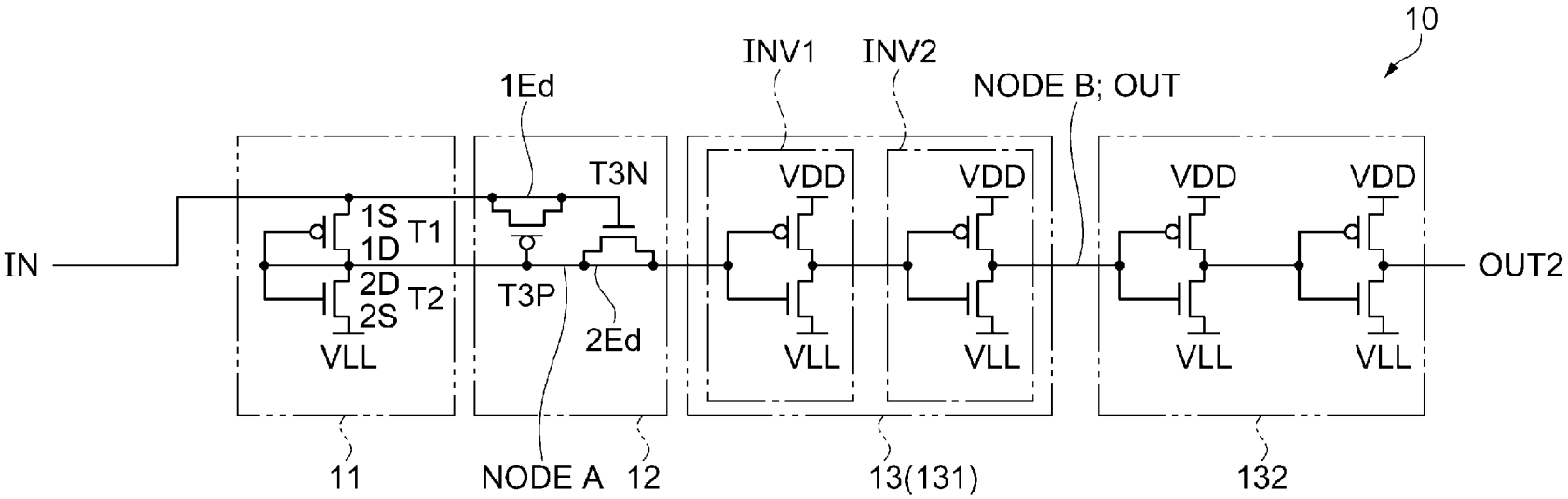
FIG. 15 is a view illustrating a level shift circuit according to a sixth embodiment.

FIG. 15 is a view illustrating a circuit configuration diagram of a level shift circuit 10 according to a sixth embodiment. Hereinafter, the configuration of a level shift circuit 10 according to this embodiment will be described with reference to FIG. 15. Furthermore, components the same as those of the third embodiment will be attached with same symbols and overlapping descriptions will be omitted.

Compared to the third embodiment (FIG. 11), in this embodiment (FIG. 15), the form of the third transistor T3 that constitutes the capacitor 12 is different. The configuration other than this is approximately the same as in the third embodiment. In the third embodiment (FIG. 11), a P-type transistor is used as the third transistor T3. With regard to this, in this embodiment, an N-type transistor and a P-type transistor are used as the third transistor T3. The arrangement of a P-type third transistor T3P is the same as in the third embodiment. In addition, an N-type third transistor T3N is installed, and to turn on the transistor, the source and the drain of the N-type third transistor T3N are electrically connected to the NODE A, and the gate of the N-type third transistor T3N is electrically connected to the input unit IN. Therefore, the first electrode 1Ed of the capacitor 12 becomes the channel forming area of the P-type third transistor T3P and the gate of the N-type third transistor T3N, and the second electrode 2Ed of the capacitor 12 becomes the gate of the P-type third transistor T3P and the channel forming area of the N-type third transistor T3N. The configuration other than this is the same as in the third embodiment. Even with this configuration, the same effect as in the third embodiment can be obtained.

Furthermore, it is possible to add various changes or improvements to the above-described embodiments without the invention being limited by the above-described embodiments.

REFERENCE SIGNS LIST

IN INPUT UNIT
INV1 FIRST INVERTER
INV2 SECOND INVERTER
OUT OUTPUT UNIT
OUT2 SECOND OUTPUT
T1 FIRST CONDUCTIVITY-TYPE TRANSISTOR
T2 SECOND CONDUCTIVITY-TYPE TRANSISTOR
T3 THIRD TRANSISTOR
T3N N-TYPE THIRD TRANSISTOR
T3P P-TYPE THIRD TRANSISTOR
1Ed FIRST ELECTRODE
2Ed SECOND ELECTRODE
V1 FIRST ELECTRIC POTENTIAL
V2 SECOND ELECTRIC POTENTIAL
V3 THIRD ELECTRIC POTENTIAL
V4 FOURTH ELECTRIC POTENTIAL
V5 FIFTH ELECTRIC POTENTIAL
V6 SIXTH ELECTRIC POTENTIAL
Vtrip LOGIC THRESHOLD ELECTRIC POTENTIAL
10 LEVEL SHIFT CIRCUIT
10C LEVEL SHIFT CIRCUIT OF THE COMPARATIVE EXAMPLE
11 ELECTRIC POTENTIAL CONVERTING UNIT
12 CAPACITOR
13 BUFFER UNIT
14 SEALING MATERIAL
15 LIQUID CRYSTAL LAYER
16 SCANNING LINE
17 SIGNAL LINE
22 ELEMENT SUBSTRATE
23 OPPOSITE SUBSTRATE
27 SHARED ELECTRODE
33 LIGHT SHIELDING FILM
34 DISPLAY AREA
35 PIXEL
36 SIGNAL LINE DRIVING CIRCUIT
37 OUTER CONNECTION ELEMENTS
38 SCANNING LINE DRIVING CIRCUITS
42 PIXEL ELECTRODE
43 FIRST ORIENTED FILM
44 SECOND ORIENTED FILM
46 TFT ELEMENT
47 CAPACITY LINE
48 MAINTAINING CAPACITY
100 LIQUID CRYSTAL DEVICE
131 FIRST BUFFER
132 SECOND BUFFER

The invention claimed is:

1. A level shift circuit comprising:

an electric potential converting unit of which an input side is electrically connected to a first node and an output side is electrically connected to a second node, and that converts a first electric potential to a third electric potential, and converts a second electric potential to a fourth electric potential;

a buffer unit of which an input side is electrically connected to the second node, and that converts the third electric potential to a fifth electric potential, and converts the fourth electric potential to a sixth electric potential; and a capacitor that is electrically connected between the first node and the second node, wherein the electric potential converting unit includes a first transistor which is any one of a N-type and a P-type of conductivity transistor and in which a source is electrically connected to the first node and a drain and a gate are electrically connected to the second node, a second transistor which is the other of the N-type and the P-type of conductivity transistor and in which a drain and a gate are electrically connected to the second node, and wherein the capacitor includes a third transistor in which a gate is electrically connected to one of the first node and a second node, and a source and a drain are electrically connected to the other of the first node and the second node, and wherein each of the drain of the first transistor and the drain of the second transistor is connected to the gate of the first transistor and the gate of the second transistor, and wherein the gate of the first transistor and the gate of the second transistor are connected to each other.

2. An electro-optical apparatus comprising the level shift circuit according to claim 1.

3. An electronic equipment comprising the electro-optical apparatus according to claim 2.

4. A level shift circuit comprising:

an electric potential converting unit that is electrically connected between a first node and a second node, converts a first electric potential to a third electric potential, and converts a second electric potential to a fourth electric potential;

a buffer unit that is electrically connected to the second node, converts the third electric potential to a fifth electric potential, and converts the fourth electric potential to a sixth electric potential; and a capacitor that is electrically connected between the first node and the second node, wherein the electric potential converting unit includes:

a first transistor in which a source and a drain are electrically connected between the first node and the second node, and a gate is electrically connected to the second node, a second transistor in which a source or a drain is electrically connected to the second node, and a gate is electrically connected to the second node, and wherein the capacitor includes a third transistor in which a gate is electrically connected to one of the first node and a second node, and a source and a drain are electrically connected to the other of the first node and the second node, and wherein each of the drain of the first transistor and the drain of the second transistor is connected to the gate of the first transistor and the gate of the second transistor, and wherein the gate of the first transistor and the gate of the second transistor are connected to each other.

5. The level shift circuit according to claim 4, wherein the third transistor is formed in the same process as that of the first transistor and the second transistor.

6. The level shift circuit according to claim 4, wherein the buffer unit includes a logic threshold electric potential, the third electric potential is a value between the logic threshold electric potential and the fifth electric potential, and the fourth electric potential is a value between the logic threshold electric potential and the sixth electric potential.

7. The level shift circuit according to claim 4, wherein the buffer unit includes at least a first inverter and a second inverter.

8. An electro-optical apparatus comprising the level shift circuit according to claim 4.

9. An electronic equipment comprising the electro-optical apparatus according to claim 8.

* * * * *